United States Patent [19]

Voss et al.

[11] Patent Number: 4,611,768

[45] Date of Patent: Sep. 16, 1986

[54] MODULAR PAPER TOWEL DISPENSER

[75] Inventors: Thomas C. Voss, Green Bay; Delos P. Lesperance, DePere; Myron F. Lindeman, Green Bay, all of Wis.

[73] Assignee: Mosinee Paper Corporation, Mosinee, Wis.

[21] Appl. No.: 751,336

[22] Filed: Jul. 1, 1985

[51] Int. Cl.[4] ..... B65H 16/00; B65H 16/02

[52] U.S. Cl. ..... 242/55.3; 242/55.53; 312/38

[58] Field of Search ..... 242/55.2, 55.3, 55.53, 242/58; 312/38, 39, 40, 41; 225/39

[56] References Cited

U.S. PATENT DOCUMENTS

| | | | |
|---|---|---|---|
| 3,637,275 | 1/1972 | Bahnsen | 312/38 |
| 3,917,191 | 11/1975 | Graham et al. | 242/55.3 |
| 4,165,138 | 8/1979 | Hedge et al. | 242/55.3 X |
| 4,223,964 | 9/1980 | Kilgore | 312/39 |
| 4,358,169 | 11/1982 | Filipowicz et al. | 242/55.3 X |
| 4,406,421 | 9/1983 | Schultz et al. | 242/55.53 |

*Primary Examiner*—Donald Watkins

[57] ABSTRACT

A paper towel dispenser cabinet including a molded plastic back (2), door (9) and mechanism module (3). The back (2) has a rear wall (16), spaced first (18) and second (19) side walls and spaced top (17) and bottom (20) walls. The door has a front wall (271), a first side wall (274) and spaced top (273) and bottom (261) walls. The mechanism module (3) includes a mechanism plate (61) and a cover (81) for housing operating mechanism for the dispensing of paper towel from the cabinet. The mechanism module (3) is secured to the back with the cover (81) coplanar with and extending from the second sidewall (19) of the back. The back (2), the door (9) and the mechanism module (3) form a cabinet enclosure for the storage of paper towel rolls in which the top and bottom walls of the door and back form the top and bottom of the enclosure, the first side walls of the door and back form one side of the enclosure, and the second side wall of the back and the mechanism module cover form the other side of the enclosure. The components of a variety of operating mechanisms can be mounted on the mechanism plate so that the mode of operation of the dispenser can be changed by simply changing mechanism modules.

14 Claims, 70 Drawing Figures

111
90
90
183
125
121
100
90
123
61

139
100
69
70
182
166
332
63
154
122
183
167
178
90
111
90
148
175

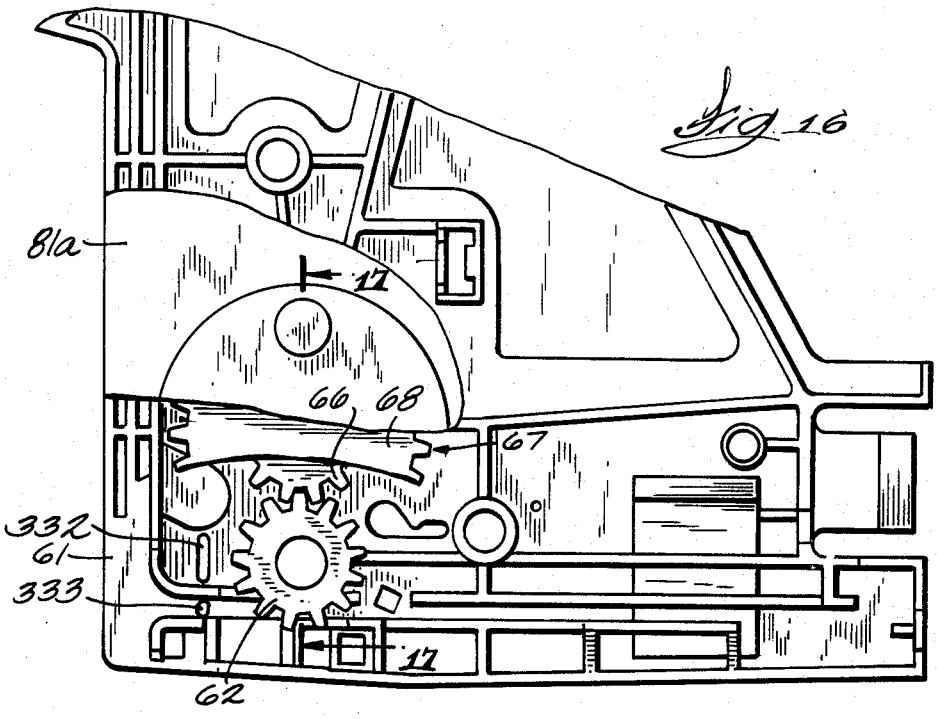
Fig. 16
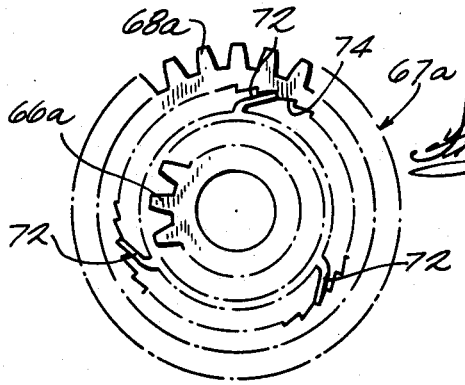
Fig. 18
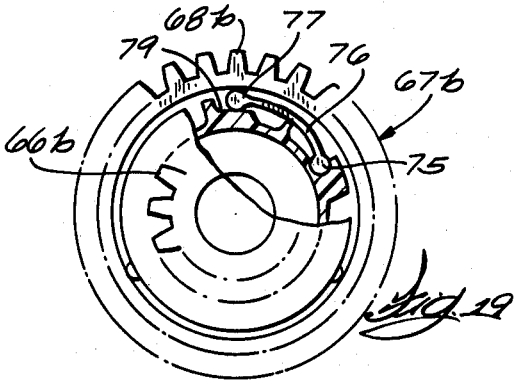
Fig. 19
Fig. 17
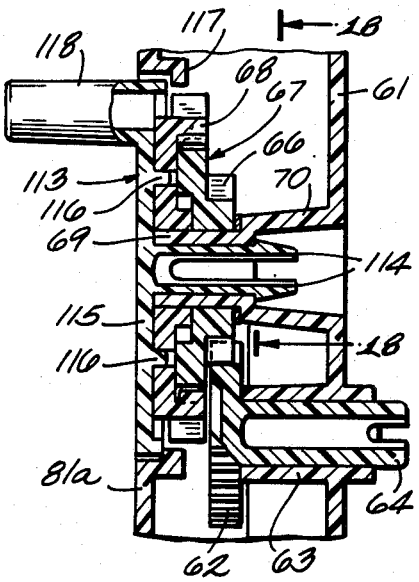

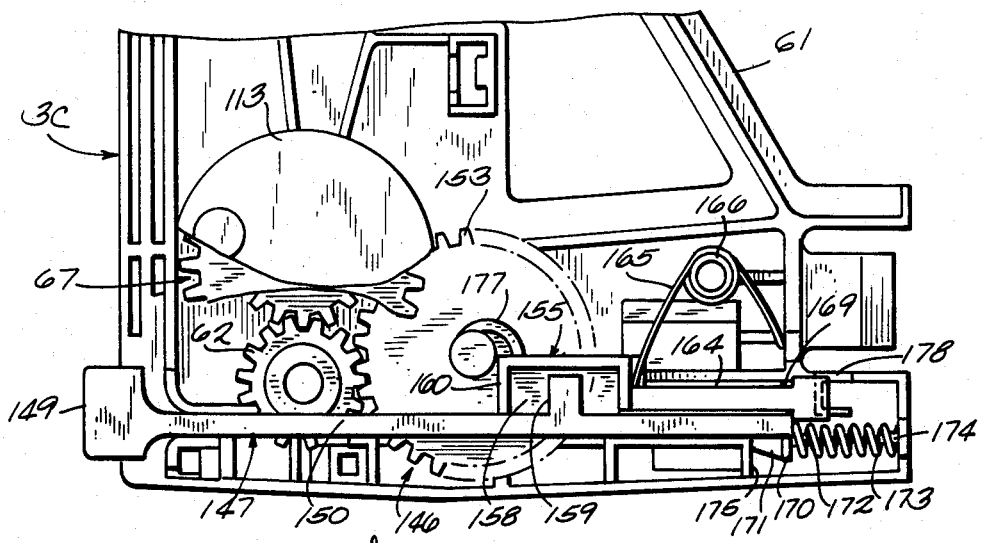
Fig. 3a.
Fig. 5b
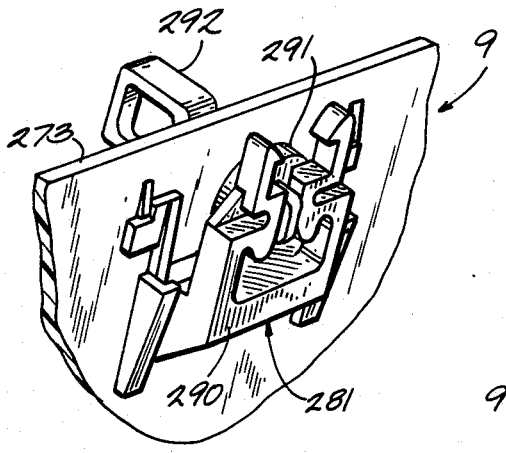
Fig. 5a
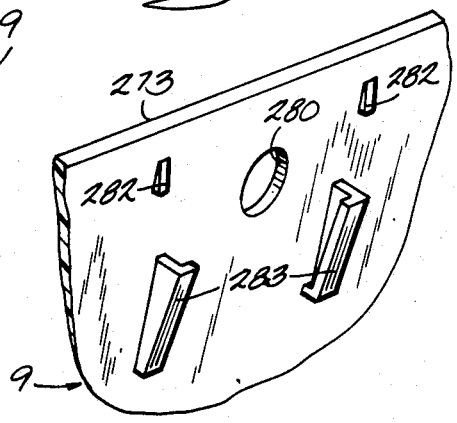

61
223
7'
330
349
266'
270'
9'

MODULAR PAPER TOWEL DISPENSER

TECHNICAL FIELD

This invention relates to the art of paper towel dispenser cabinets of the type adapted to store one or more rolls of paper toweling and including an operating mechanism that allows a user to withdraw toweling from the rolls.

BACKGROUND OF THE INVENTION

Dispensers for flexible sheet material such as paper toweling have long been known. They find their widest application in public lavatories where they hang on walls to dispense paper toweling for users to dry their hands. The dispensers usually have a crank, a lever or a metered crank mechanism which the user operates to dispense toweling. The crank and lever mechanisms are continuously operable so that the user can withdraw any length of towel, whereas the metered crank mechanism allows the user to withdraw only a predetermined length of towel so as to thereby conserve paper.

The following patents are representative of the prior art:

| U.S. Pat. No. | Issue Date | Original Assignee |
|---|---|---|
| 3,382,021 | 5/07/68 | Continental Mfg. Co. |
| 3,606,125 | 9/20/71 | Towlsaver, Inc. |
| 3,613,880 | 10/19/71 | Towlsaver, Inc. |
| RE 28,911 | Reissued 7/20/76 | Georgia-Pacific Corp. |
| 4,106,684 | 8/15/78 | Crown Zellerbach Corp. |
| 4,165,138 | 8/21/79 | Mosinee Paper Co. |
| 4,260,117 | 4/07/81 | Towlsaver, Inc. |

Prior art dispensers generally comprise a back or body, paper feed rollers, a dispensing mechanism operable by the user to drive the feed rollers, and a door or cover. The preferred material for the various components in most of the prior art dispensers was sheet metal, with the exception that the feed rollers were usually made of wood.

Prior art dispensers usually required many different parts and were attended by complex secondary operations to assemble a dispenser. For example, a body for a dispenser may have required a cutting element with which to sever a dispensed length of paper toweling, hinge elements to connect a door to the body, and a lock to lock the door shut against the body to inhibit unauthorized opening. Each of these parts was mechanically fastened to the body, such as by riveting. This required at least three different subassembly stations on at least three different machines using relatively complicated tooling which was quite susceptible to breakdown. Of course, the maintenance and replacement of tooling required for these secondary operations was expensive, but, even more importantly, the time it took to perform the operations was expensive.

The prior art constructions also aggravated inventory control and production planning problems. In production, each individual part of an assembly and each subassembly operation must be accounted for to insure that the requisite parts and subassemblies are available to meet production demands. Accordingly, the difficulty of inventory and production planning is directly proportional to the number of parts and secondary operations required to produce a finished product. Moreover, in the prior art, the susceptibility of the secondary operation machines to breakdown continuously threatened the production planner with preventing him or her from meeting the production schedule.

Also, the structure of prior art dispensers did not provide for facile conversion of a dispenser's mode of operation, for example, from a crank mode to a lever mode. While the prior art encompasses dispensers having various parts of their dispensing mechanisms together in a single subassembly, the prior art does not disclose a flexible design system in which a dispenser mechanism module is an interchangeable part of the dispenser cabinet wall structure to provide facile conversion of the dispenser's mode of operation by simply changing the module. Interchangability of a mechanism module unit is desirable because it provides for ease of assembly, simplifies production planning as the various modules can be subassembled and subsequently combined with the other common dispenser components to produce a dispenser of the desired mode, and provides for relative ease of service in the field.

SUMMARY OF THE INVENTION

A paper towel dispenser cabinet of the present invention includes a molded plastic back having a rear wall, spaced top and bottom walls, and spaced first and second side walls. A molded plastic door having a front wall, spaced top and bottom walls and a first side wall is hingedly connected to the back. A mechanism module houses an operating mechanism for the dispensing of paper towel from the cabinet and is secured to the back with an outer member of the mechanism module coplanar with and extending from the second side wall of the back. The back, door and mechanism module form a cabinet enclosure for the storage of paper towel rolls. The top and bottom walls of the door and the back form the top and the bottom of the enclosure, the first side wall of the door and the first side wall of the back form one side of the enclosure, and the second side wall of the back and the outer member of the mechanism module form an opposite side of the enclosure.

DESCRIPTION OF THE DRAWINGS

The present invention is described below, as required by 35 U.S.C. §112, in such full detail as to enable those skilled in the art to practice the invention and also to set forth the presently-contemplated best modes for its practice, all by reference to the following drawings in which:

FIG. 8 is a perspective view of the back for the dispenser of FIG. 1 as viewed from the right side;

FIG. 16 is a fragmentary view of the mechanism module of FIG. 13 which is assembled to provide an unmetered crank mode of operation and with portions broken away to show details of construction;

FIG. 17 is a sectional view taken from the plane of the line 17—17 of FIG. 16;

FIG. 18 is a detail view of an overrunning clutch for the mechanism module of FIG. 16 taken from the plane of the line 18—18 of FIG. 17;

FIG. 19 is a detail view of a second embodiment of an overrunning clutch for the mechanism module of FIG. 16 taken from the plane of the line 18—18 of FIG. 17;

FIG. 32 is a fragmentary view with portions broken away of a third embodiment of a mechanism module which is assembled to provide a metered crank mode of operation;

FIG. 56 is a perspective detail view of a portion of the door;

FIG. 58 is a perspective detail view of the lock assembled to the door;

DETAILED DESCRIPTION OF THE PREFERRED EMBODIMENT

Figure 1:
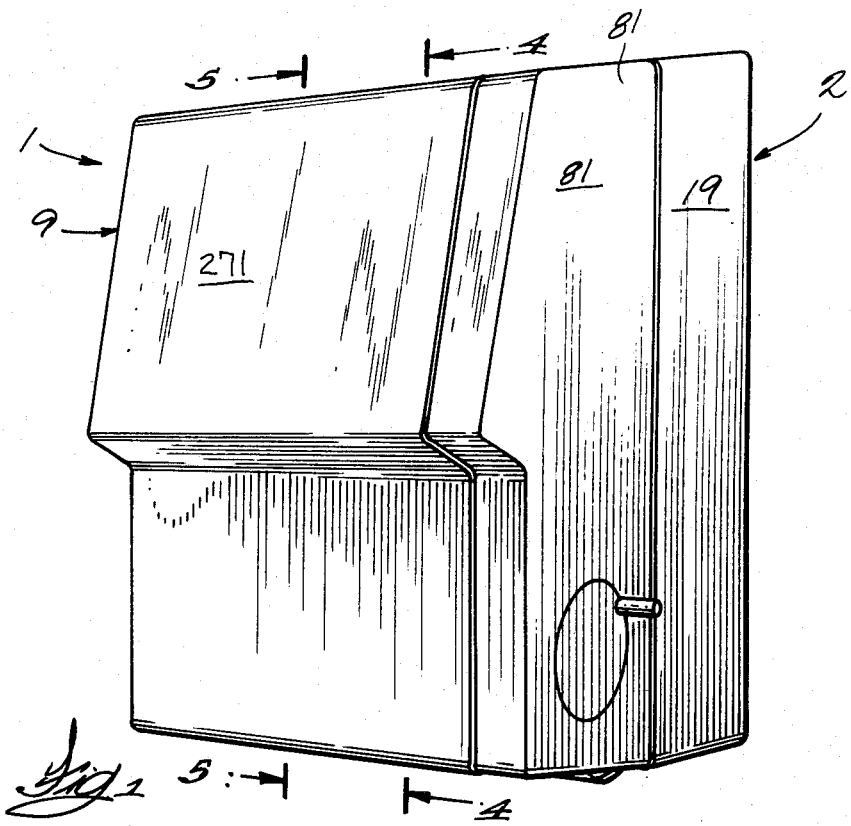
FIG. 1 is a perspective view of a paper towel dispenser cabinet constructed in accordance with this invention.
Figure 2:
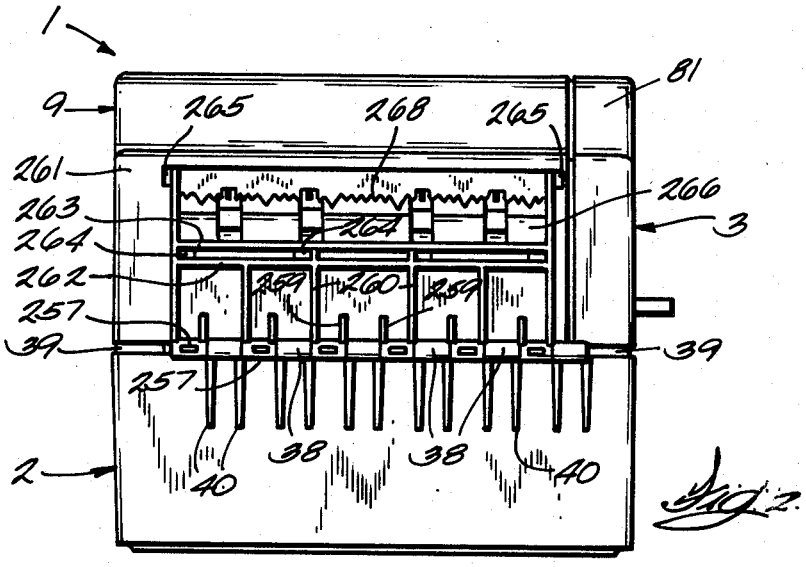
FIG. 2 is a bottom plan view of the dispenser of FIG. 1.
Figure 3:
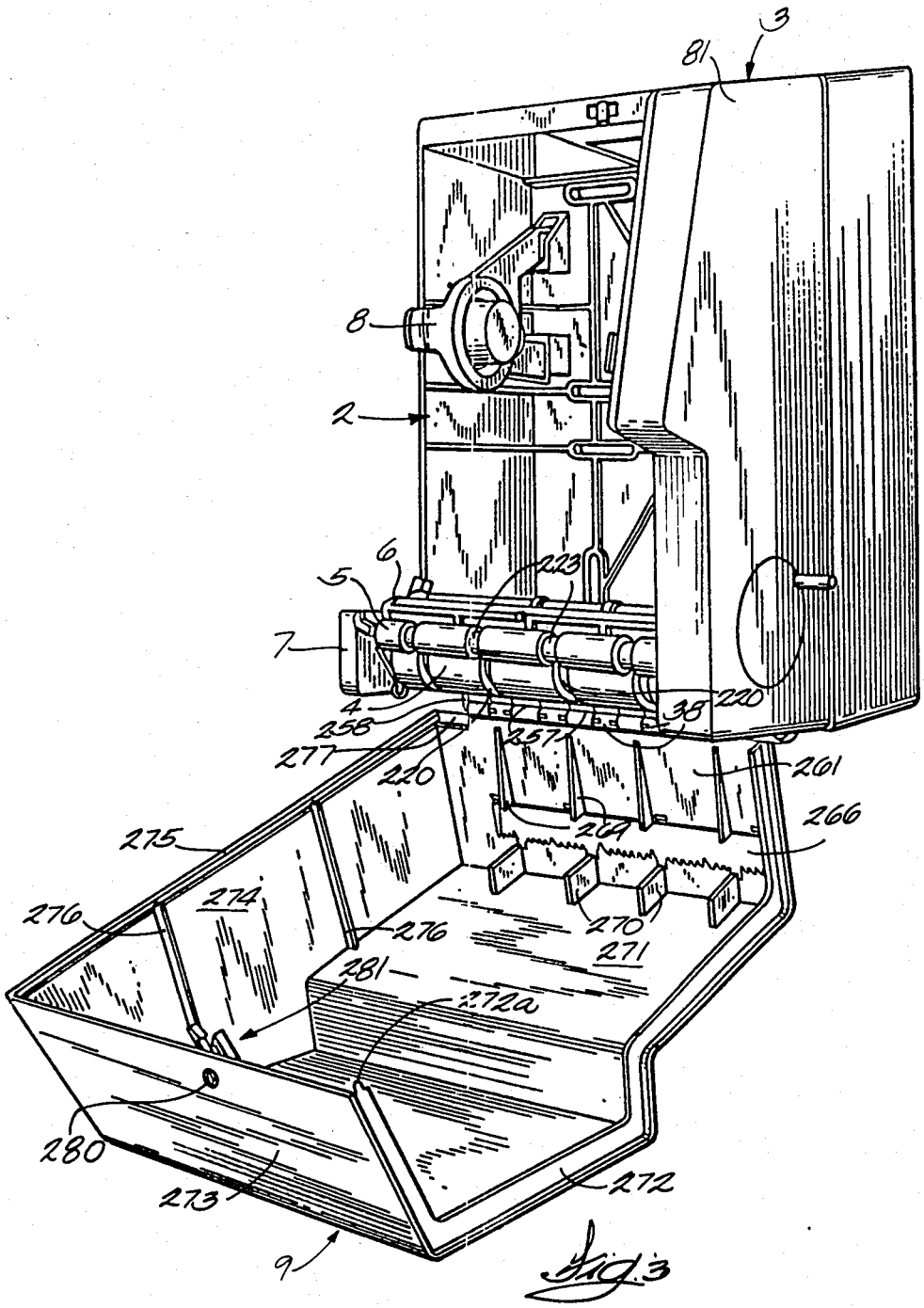
FIG. 3 is a perspective view of the dispenser of FIG. 1 shown with the door open.

FIGS. 1-7 show a complete assembled dispenser cabinet of the present invention. Referring particularly to FIGS. 1-3, the dispenser cabinet 1 includes a back 2 to which all of the other components are mounted and which makes up the rear portion of the dispenser housing. A mechanism module 3 is attached to the back 2 to form the right side of the dispenser and carries the right hand ends (FIG. 3) of a drive roll 4, an idler roll 5 and a transfer bar 6. The mechanism module 3 also houses the drive mechanism which a user operates to dispense a length of toweling and is the only variable element among dispensers providing different modes of operation. A feed roll support arm 7 extends from the back 2 and supports the left hand ends of the drive roll 4, the idler roll 5 and the transfer bar 6. A reserve roll support arm 8 is assembled to the back 2 above the support arm 7 and a lockable door 9 which is hingedly connected to the back completes the dispenser cabinet 1.

Figure 4:
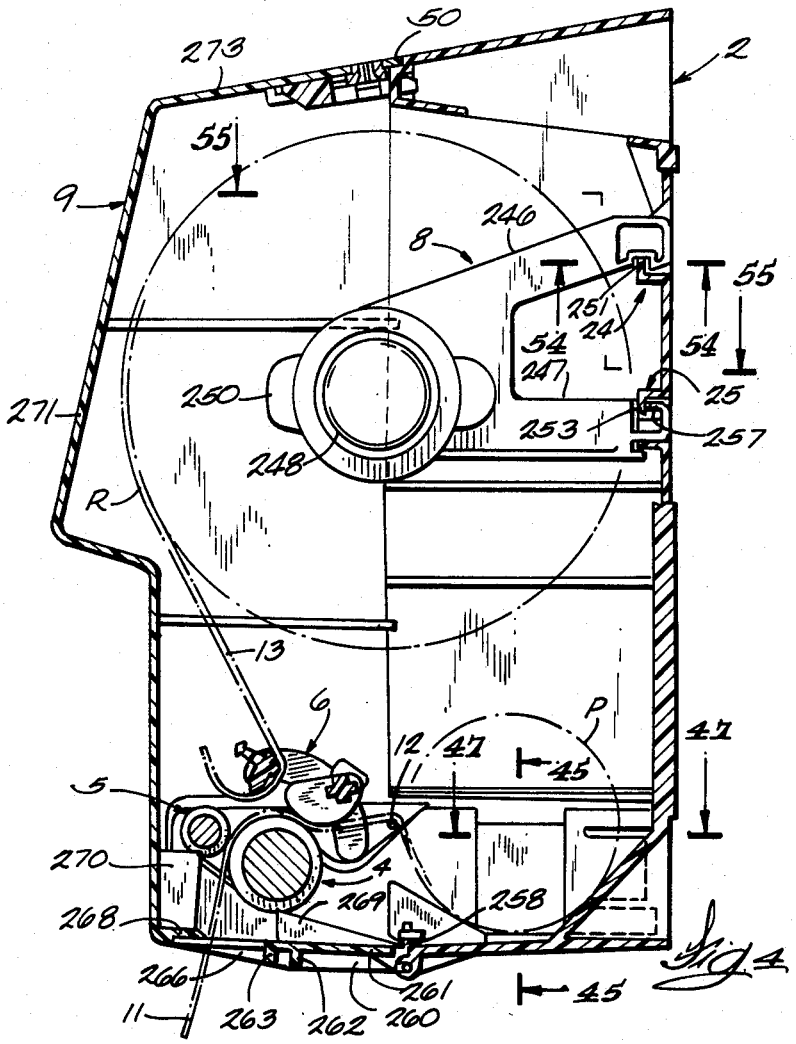
FIG. 4 is a sectional view taken along the plane of line 4—4 of FIG. 1.

In service, the back 2 is secured to a wall (not shown). Referring to FIG. 4, a web 11 of paper towel from a primary roll P supported in the bottom of the back is first threaded up over a rod 12 which spans the feed roll support arm 7 and the mechanism module 3. It has been found that by mounting the rod 12 so that it is non-rotatable, it provides an even drag across the width of the towel to result in an even dispensing action. The web 11 is then threaded between the drive roll 4 and the transfer bar 6, and into the nip between the drive and idler rolls 4 and 5, respectively, to be frictionally engaged by the drive roll 4. A web 13 of paper towel from a reserve roll R which is supported at one end by the reserve roll support arm 8 and at its other end by the mechanism module 3 is threaded through the transfer bar 6 and up over the idler roll 5. When a user operates the mechanism module 3, the drive roll 4 is rotationally driven to dispense a length of the web 11 from the primary roll P. When the primary roll P is exhausted and the end of its web passes by the transfer bar 6, the transfer bar urges the reserve roll web 13 into the nip between the drive and idler rolls to be dispensed. The details of operation of the transfer mechanism are not essential to the present invention but are more particularly described in Hedge et al. U.S. Pat. No. 4,165,138, issued Aug. 21, 1979, the disclosure of which is hereby incorporated by reference.

Having set forth the major components of the dispenser and described its general operation in service, a more detailed description of each component is set forth below under appropriate subheadings.

(1) The Back

Figure 9:
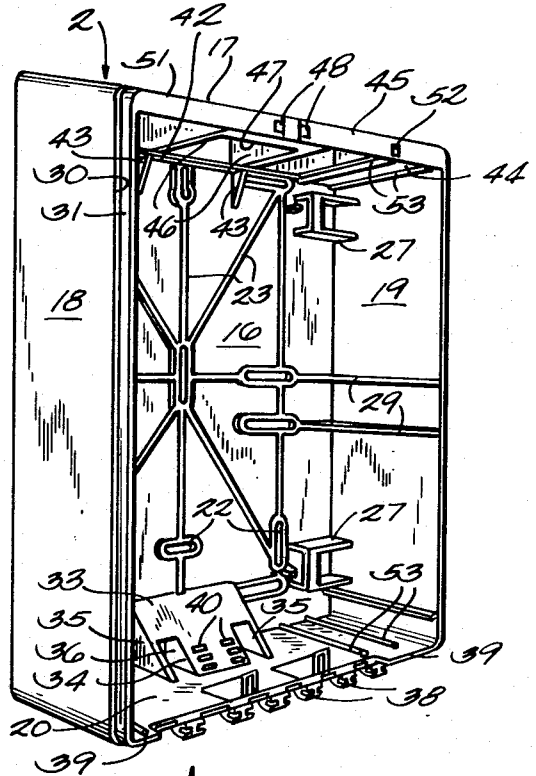
FIG. 9 is a perspective view of the back shown in FIG. 8 as viewed from the left side.

FIGS. 8 and 9 show the back 2 apart from the dispenser 1. It is injection molded in one piece from a plastic such as high impact ABS and is generally rectangular, including a rear wall 16 and top, left side, right side and bottom walls 17, 18, 19 and 20, respectively.

Figure 7:
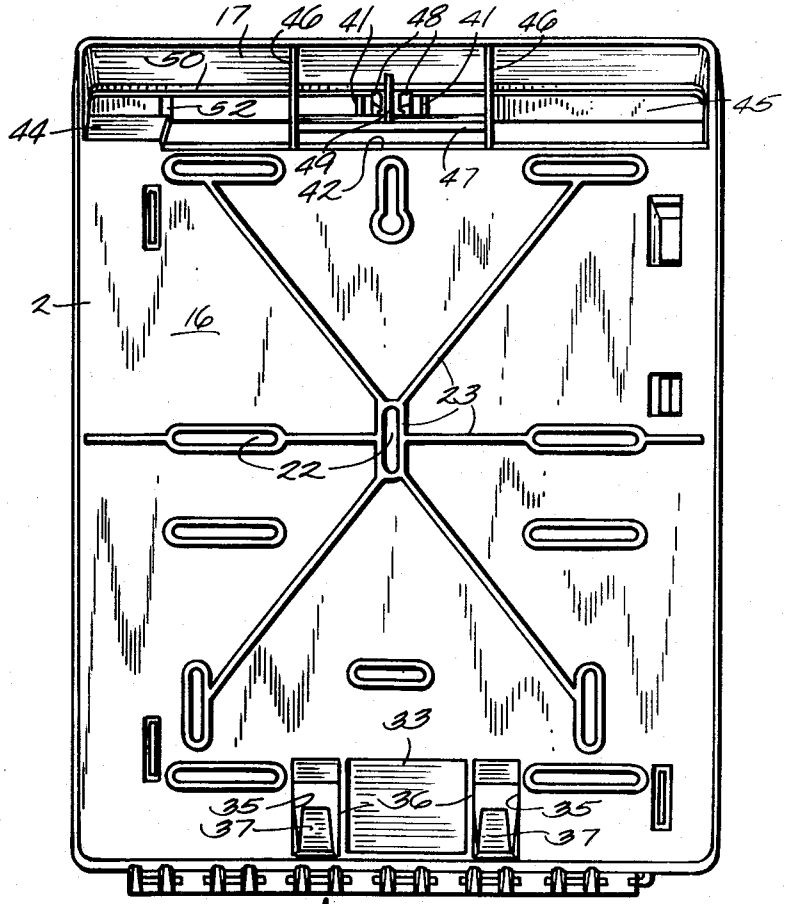
FIG. 7 is a rear plan view shown with the door closed.

The back 2 has a number of mounting slots 22 to allow for various fastener patterns to securely attach the dispenser to a wall. One or two properly located fasteners near the top and one or two further down is adequate for this purpose. The periphery of the slots is thickened and reinforcement ribs 23 are provided between the slots on the front surface of the rear wall for added strength. As can be seen in FIG. 7, reinforcement ribs 23 also span the backside of the rear wall 16 and extend outwardly from the center slot 22 for added strength and for stability against a wall.

The back 2 has a number of locking structures for holding the various components of the dispenser in place. The specific configurations of the locking structures are described below in conjunction with the components which they mount. Suffice it to say here that the upper left zone of the rear wall 16 includes locking structures 24 and 25 which mount the reserve roll support arm 8, the lower left zone of the rear wall includes a locking structure 26 which holds the feed roll support arm 7 in place, and the upper and lower right zones of the rear wall each include a locking structure 27 which lock the mechanism module 3 in position.

The rear wall 16 is integral with the side walls 18 and 19. The locking structures 24, 25, 26, and 27 are connected by webs of plastic to their adjacent side walls to enhance the strength of both the side walls and the locking structures. The side walls are further strengthened by triangular reinforcement ribs 29. The exterior surface of each side wall has a ledge 30 spaced a short distance back from the front edge of the side wall which runs the full length of the side wall. The resulting recessed front edges 31 of the side walls fit within the door 9 and the mechanism module 3 to add rigidity to the assembled dispenser as will be more fully described below.

The bottom wall 20 is integral with the rear and side walls. The central portion of the rear wall 16 is connected to the bottom wall 20 by a planar ramp 33 having two cut out portions 34. Fillets 35 on the ends of the ramp 33 also connect the rear wall to the bottom wall, as do fillets 36 on the inside sides of the cut out portions 34 as best shown in FIGS. 7-9. Opposite the cut out portions 34, two ramps 37 are molded into the bottom wall 20. The ramp 33 and ramps 37 cradle the primary roll P in position as it is unrolled. The lower central portion of the ramp 33 is provided with resistance ribs 40 to prevent the primary roll P from unfurling as it is unrolled. The central portion of the front edge of the bottom wall 20 is cut away to provide room for hinge elements 38, which are integral with the bottom wall and are molded in a fashion which is well known in the plastic injection molding art. The exterior of the bottom wall 20 also has recessed edges 39 which are continuations of the side wall recessed edges 31 and are best shown in FIG. 2. Also as shown in FIG. 2, each hinge element 38 is reinforced with a pair of ribs 40 on the exterior of the bottom wall.

Referring to FIGS. 6-9, the side walls 18 and 19 extend above where the rear wall 16 terminates and are integral with the top wall 17 so that an open space exists between the top wall 17 and the rear wall 16. The top wall slopes downwardly from rear to front and the side walls 18 and 19 are slightly thicker above the rear wall 16 for added strength. The top edge of the rear wall 16 includes a flange 42 which extends a short distance forward, the flange being integral with the left side wall 18 and reinforced to the rear wall 16 by two fillets 43. The right edge of the flange 42 meets and is integral with a guide wall 44 which itself meets and is integral with the rear wall 16 along its rear edge, the right side wall 19 along its right edge, and a lock wall 45 along its front edge. The lock wall 45 is integral with and extends a short distance downward from the front edge of the to wall 17. Above the fillets 43 and integral with the flange 42 are two vertical reinforcing webs 46 which meet and are integral with the top wall 17 and the lock wall 45 as best shown in FIGS. 7, 8 and 9. Spanning the lower forward edges of the reinforcing webs 46 is a horizontal reinforcing web 47, which is also integral with the lock wall 45. The central portion of the lock wall 45 has two lock apertures 48 formed in it. A vertical reinforcing web 49 shown in FIG. 7 is intermediate the lock apertures 48 and meets and is integral with the horizontal reinforcing web 47, the lock wall 45 and the top wall 17. A pair of vertical reinforcing webs 41, one adjacent to the outer edge of each aperture 48, are also integral with the horizontal reinforcing web 47, the lock wall 45 and the top wall 17. While the side wall ledges 30 terminate at the top wall, the exterior surface of the top wall includes a ledge 50 spaced a short distance forward of where the side wall ledges 30 terminate. The ledge 50 forms a recessed front edge 51 on the top wall similar to the recessed front edges of the sidewalls and the bottom wall. Also, the right portion of the lock wall 45 has a guide aperture 52 formed in it.

Each of the guide, left side, right side, and bottom walls 44, 18, 19 and 20, respectively, have one or more special purpose ribs which serve functions apart from reinforcement. The guide wall and the bottom wall are provided with pairs of wedge ribs 53 to mount the mechanism module 3. Each rib 53 is wider at the rear than at the front so that the distance between the ribs of a pair is less at the back than at the front as best shown in FIG. 10.

Figure 11:
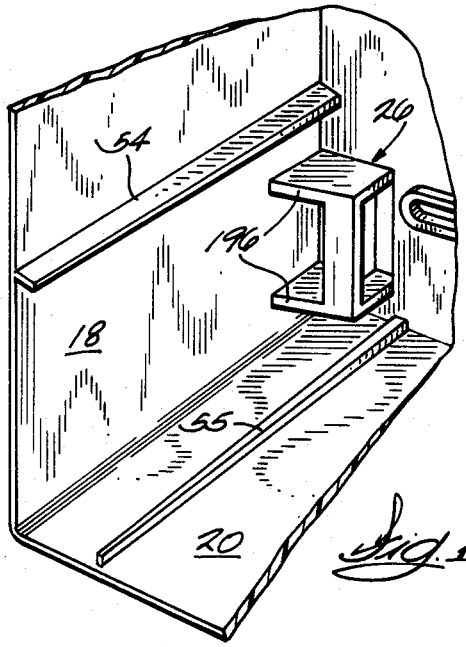
FIG. 11 is a detail view of the lower left corner of the back as viewed in FIG. 8.

Similarly, a wedge rib 54 is provided on the left side wall 18 and a wedge rib 55 is provided on the bottom wall 20 to mount the feed roll support arm 7. As best shown in FIG. 11, the wedge rib 54 is angled downwardly away from the left side wall 18 and thickens toward the rear so that the distance from the rib 54 to the bottom wall 20 is greater at the front than at the rear. The wedge rib 55 on the bottom wall 20 is thicker at the rear than at the front so that the distance between it and the left side wall 18 is greater at the front than the rear.

Figure 12:
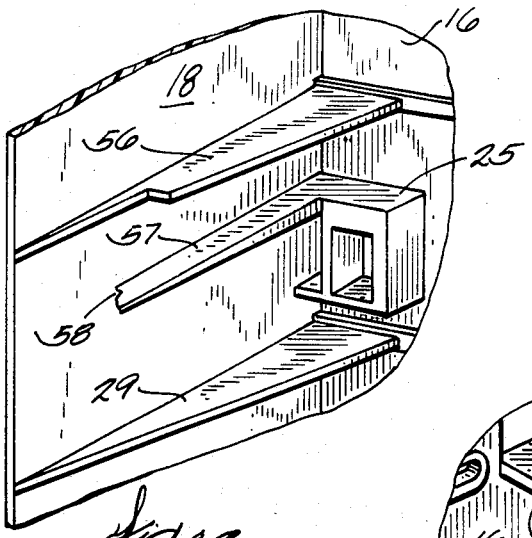
FIG. 12 is a detail view of an interior portion of the left side of the back as viewed in FIG. 8.
Figure 10:
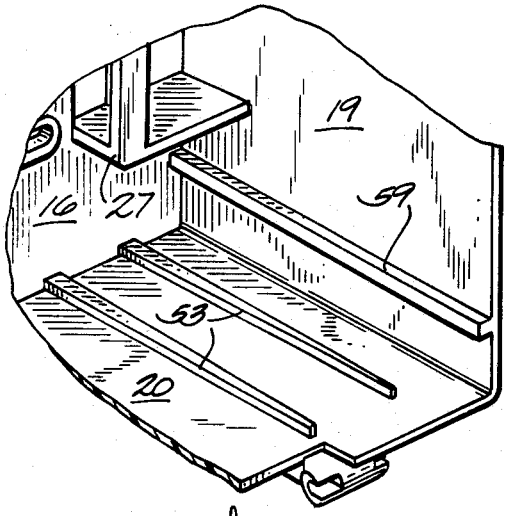

The left side wall includes a stop rib 56 and a spring retainer rib 57 which have functions related to the reserve roll support arm 8. As best shown in FIG. 12, the stop rib 56 is similar to the triangular reinforcement ribs 29 but is cut away at its forward end. The stop rib 56 serves to limit the outwardly swinging movement of the reserve roll support arm 8. The spring retainer rib 57 has a notch 58 at its end which serves to captivate the end of a spring which biases the reserve roll support arm inwardly.

Figure 10:
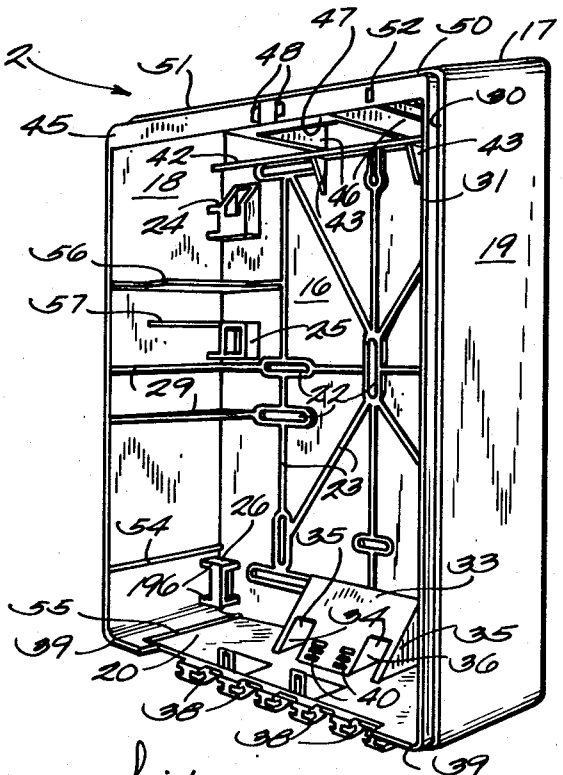
FIG. 10 is a detail view of the lower right corner of the back as shown in FIG. 9.

The right side wall 19 has a shallow, straight spacer rib 59 (FIG. 10). The rib 59 provides a bearing surface for the mechanism module in some modes of operation. The function of rib 59, and all the other special purpose ribs, will be more fully explained under the appropriate subheadings below.

(2) The Mechanism Module

Figure 14:
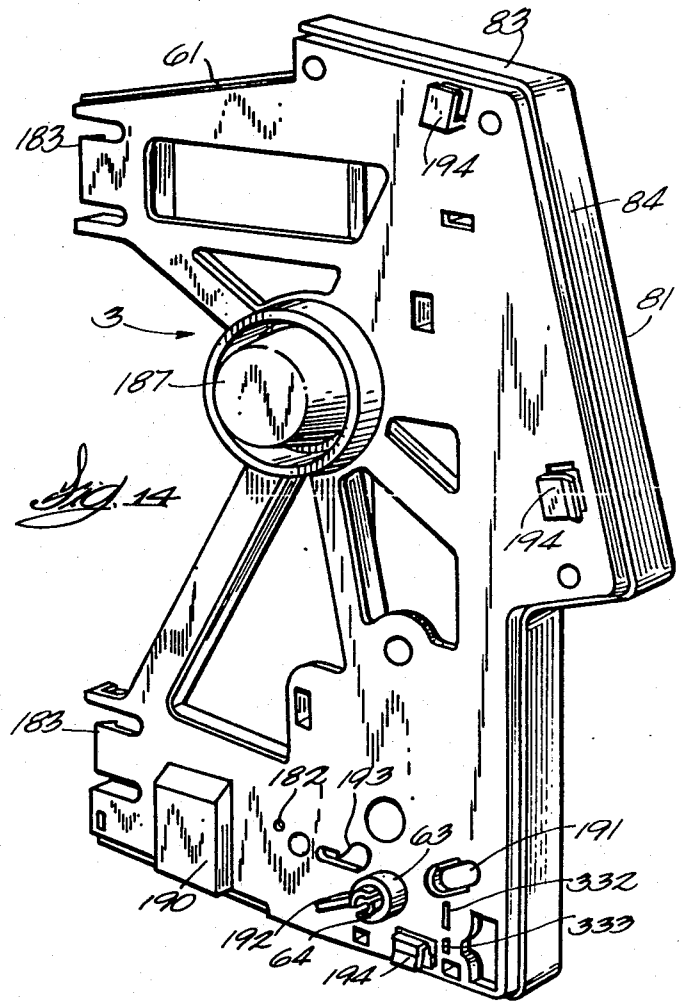
FIG. 14 is a perspective view of the mechanism module of FIG. 13 as viewed from the left front side.
Figure 13:
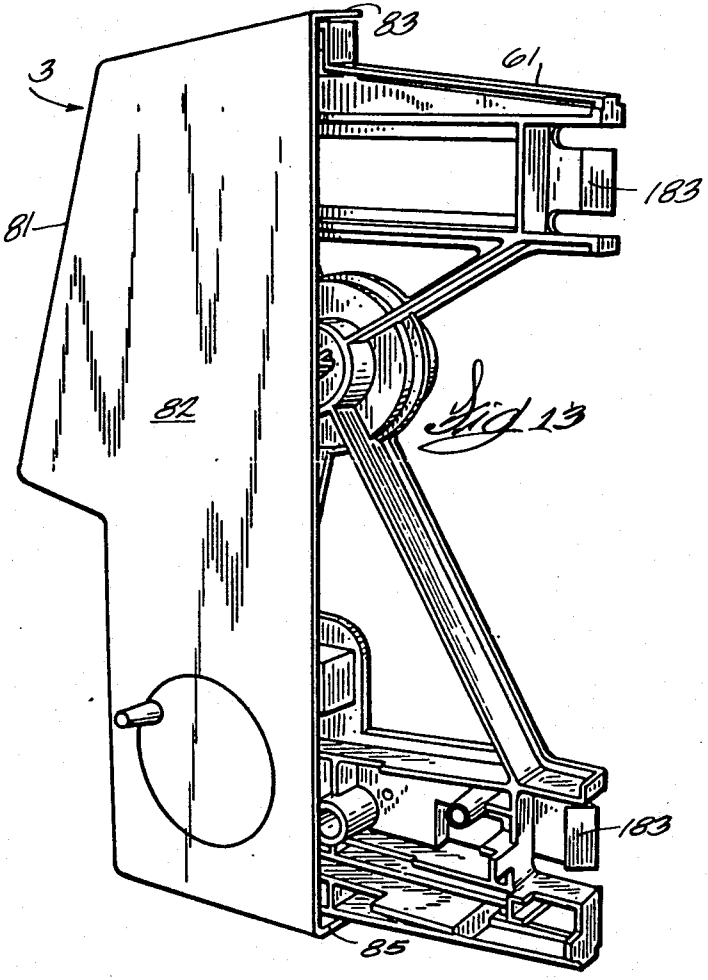
FIG. 13 is a perspective view of the mechanism module for the dispenser of FIG. 1 as viewed from the right rear side.

FIGS. 13 and 14 show the mechanism module 3 apart from the dispenser. The mechanism module is an important subassembly of the dispenser because it serves a dual purpose which enables it to be the only variable element among dispensers exhibiting different modes of operation. First, the mechanism module houses a dispensing mechanism which is operable by the user to dispense a length of sheet material. Second, the mechanism module forms a structural portion of the dispenser cabinet. Thereby, the mode of operation of the dispenser can be changed simply by changing the mechanism module.

Figure 15:
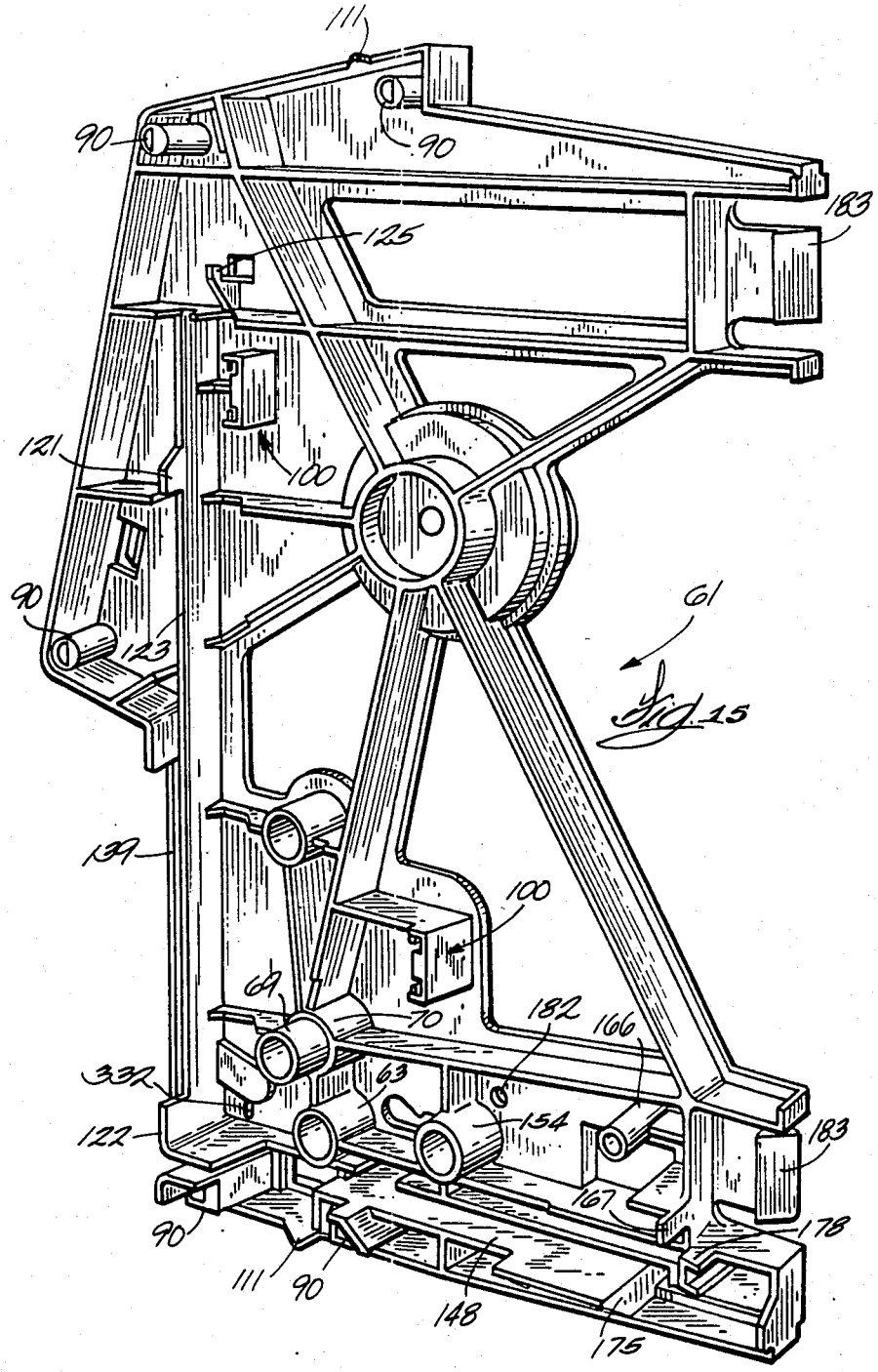
FIG. 15 is a perspective view of a mechanism plate for the mechanism module of FIG. 13 as viewed from the right rear side.

A major component of the mechanism module 3 is the outer member or mechanism plate 61 which is illustrated in FIG. 15. The mechanism plate is molded in one piece from a plastic such as high strength ABS or other suitable material. It forms one of the basic building blocks from which several mechanism modules, each exhibiting a different mode of operation, can be built. In other words, the mechanism plate 61 is the same for all the dispensers regardless of the dispenser's mode of operation. Its several elements are described below in conjunction with the description of the mechanism modules exhibiting various modes of operation.

(a) Unmetered Crank Mode

One mode of operation is the unmetered crank mode. All figures discussed thus far which show a mechanism module 3 illustrate a mechanism module of the unmetered crank mode. It is the simplest mode, requiring the fewest parts to assemble. In this mode, the user simply turns a crank on the side of the mechanism module to dispense a length of toweling. A mechanism module exhibiting this particular mode of operation will hereinafter be referred to as mechanism module 3*a*.

FIGS. 16 and 17 show the drive train of a mechanism module 3*a*. All gears shown are made of a suitable plastic or material, such as acetal resin for example.

A drive pinion 62 having an integral shaft is journaled in a sleeve 63 which is integral with the mechanism plate 61 and is strengthened by reinforcing ribs. The sleeve 63 extends a short distance from the drive roll side of the mechanism plate 61 and the end 64 of the drive pinion shaft extends beyond the end of the sleeve. The end 64 of the drive pinion shaft is forked to rotationally engage the drive roll.

The drive pinion 62 meshes with a clutch gear 66 of an overrunning clutch 67 which also includes a drive gear 68. The overrunning clutch 67 is rotationally mounted on a stub sleeve 69 projecting from a larger diameter sleeve 70 which is integral with the mechanism plate 61 and which is strengthened by reinforcing ribs. The overrunning clutch 67 insures that the drive pinion 62 will be driven in only one direction so that the drive roll cannot be rotated backwardly.

The overrunning clutch 67 may take any of a number of forms. One such form is the clutch 67*a* shown in FIG. 18. In clutch 67*a*, the clutch gear 66*a* has a number of pawls 72 on a rearward hub which engage an inner ratchet surface 74 of the drive gear 68*a* when the drive gear 68*a* is rotated clockwise as viewed in FIG. 16. If the drive gear 68*a* is rotated counter-clockwise relative to the clutch gear 66*a* as viewed in FIG. 16, the friction of the drive system is sufficient to hold the clutch gear 66*a* still so that the pawls 72 overrun the ratchet surface 74 and make a noise which puts the user on notice that he is cranking in the wrong direction. Alternatively, if silent overrunning operation is desirable, the clutch 67B of FIG. 19 could be used. In this arrangement, the clutch gear 66*b* has a rearward hub within the drive gear 68*b* which captivates a cylindrical end 75 of each of three flexible clutch dogs 76, one of which is shown.

The other cylindrical end 77 of each of the clutch dogs 76 is frictionally engaged between an inner surface of the drive gear 68*b* and a raised surface 79 on the hub of the clutch gear 66*b*. When the drive gear 68*b* is rotated clockwise as viewed in FIG. 16, the wedging action of the clutch dogs 76 locks the clutch gear 66 to the drive gear 68*b* so that the two gears rotate together. When the drive gear 68*b* is rotated counterclockwise as viewed in FIG. 16, the friction in the drive system holds the clutch gear 66*b* still as the drive gear 68*b* rotates freely.

Figure 20:
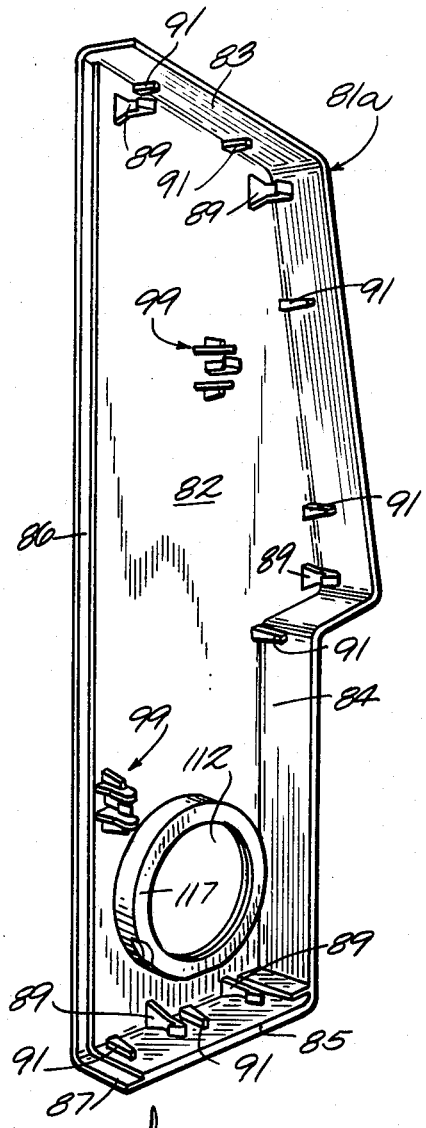
FIG. 20 is a perspective view of a cover for the mechanism module of FIG. 16 as viewed from the left rear side.

A molded plastic outer member or cover 81 forms part of the mechanism module. It is assembled to the mechanism plate 61 after the gears are positioned and makes up an exterior portion of the dispenser cabinet, being coplanar with and extending from the right side wall 19 of the back. It is therefore preferably molded from the same type of high impact plastic as the back 2 and the door 9 so that it matches the rest of the cabinet. The particular cover shown in FIG. 20 is specially adapted for the unmetered crank embodiment and will hereinafter be referred to as cover 81*a* when particular reference is necessary.

As shown in FIGS. 13 and 14, the cover 81 includes a sidewall 82 from which extend top, front and bottom walls 83, 84, and 85, respectively. The sidewall 82 overlays the front portion of the side of the mechanism plate 61 and the top, front and bottom walls overlap the corresponding edges of the mechanism plate. Also, as shown in FIG. 20, the rear inside edges 86 and 87 of the sidewall 82 and the bottom wall 85, respectively, are recessed.

The cover 81 is attached to the mechanism plate 61 with two different types of snap-locking connections. Five male connectors 89 around the periphery of the cover (FIG. 20) and five mating female connectors 90 around the periphery of the mechanism plate 61 (FIG. 15) comprise one type of connection. This type does not provide any support against movement of the cover side wall 82 toward the mechanism plate 61. However, no support need be provided by these connections since the cover is supported by ribs 91 provided on the insides of the top, front, and bottom walls of the cover 81. The outer ends of the ribs 91 abut the side edges of the mechanism plate 61 to support the cover 81 away from the mechanism plate 61 around its top, front and bottom edges thereby allowing the use of connectors 89 and 90 around the edges.

Figure 22:
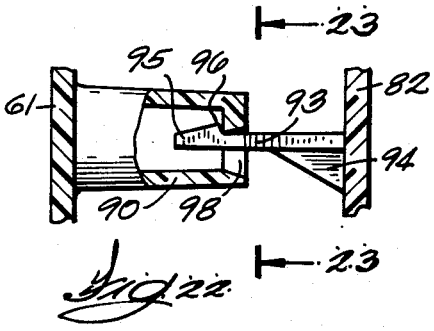
FIG. 22 is another detail view with portions broken away of the snap locking connector of FIG. 21.
Figure 23:
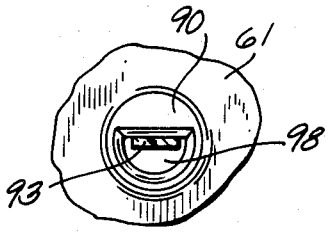
FIG. 23 is a sectional view taken from the plane of the line 23—23 of FIG. 22.
Figure 21:
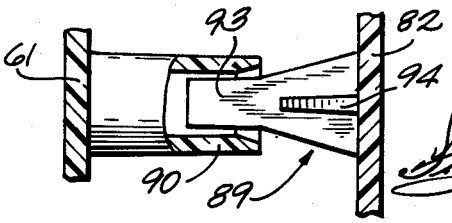
FIG. 21 is a detail view with portions broken away of one type of snap locking connector for mounting the cover of FIG. 20 to the mechanism plate of FIG. 15.

Referring to FIGS. 21, 22, and 23, each male connector 89 has a resilient tab 93 which projects from the inside of the cover side wall 82. The tab 93 is stiffened by a fillet 94 at its base and is provided with a ramped portion 95 at its outer end which terminates in a ledge 96. The female connector 90 on the mechanism plate 61 is a hollow cylindrical projection having a roughly semicircular opening 98 at its outer end along the front and top walls of the mechanism plate 61. The two female connectors 90 adjacent to the bottom wall of the mechanism plate 61 are differently shaped, being rectangular with rectangular openings, but function the same as the cylindrical female connectors. The edges of the opening 98 which lead into the interior of the connector 90 are beveled to easily align with and receive the ramped end 95 of the tab 93. The ramped end 95 bears against the straight side of the opening 98 and is urged away from the straight side into a stressed condition as the tab 93 enters the opening. When pressure is applied to the cover to move the tab 93 further into the connector 90, the ledge 96 of the tab snaps behind the straight edge of the opening 98 to lock the connectors 89 and 90 together to hold the cover securely against the mechanism plate.

Figure 25:
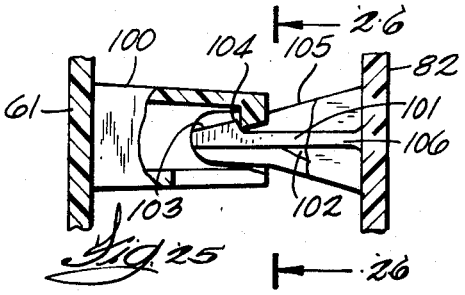
FIG. 25 is another detail view with portions broken away of the snap locking connector of FIG. 24.
Figure 26:
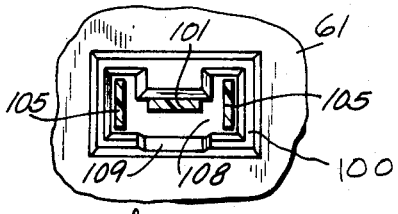
FIG. 26 is a sectional view taken along the plane of the line 26—26 of FIG. 25.
Figure 24:
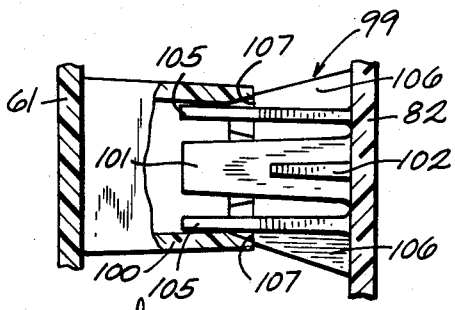
FIG. 24 is a detail view with portions broken away of a second type of snap locking connector for mounting the cover of FIG. 20 to the mechanism plate of FIG. 15.

Two male connectors 99 are provided on the interior of the cover side wall 82 and two corresponding female connectors 100 are provided on the interior of the mechanism plate 61 which provide support against movement of the cover toward the mechanism plate. Referring to FIGS. 24, 25, and 26, each male connector 99 has a resilient tab 101 which is stiffened by a fillet 102 at its base and which has a ramped outer end 103 that terminates in a ledge 104. The tab 101 is flanked on each side by a guide tab 105 which has an arcuate end and that is stiffened by a fillet 106 having a surface 107 which is at a right angle to the guide tab 105. Each female connector 100 on the mechanism plate is a hollow rectangular projection with a C-shaped opening 108 at its outer end. The edges of the C-shaped opening 108 are beveled to receive the ramped end of the tab 101 and the arcuate ends of the guide tabs 105. A cut-out 109 is provided in the side wall of each female connector 100 opposite from the tab 101 to provide clearance for the tab to bend outwardly as it enters the C-shaped opening 108. When pressure is applied to move the male connector 99 further into the female connector 100, the surfaces 107 of the fillets 106 abut the face of the C-shaped opening 108 and the ledge 104 of the tab 101 snaps behind the edge of the C-shaped opening. This arrangement locks the connectors together and supports the cover 81 away from the mechanism plate 61.

Regardless of the type of connector, the tabs 93 and 101 must be held against the edges of their respective openings 98 and 108. For this reason, the ramped ends of all of the tabs 93 and 101 face rearwardly and an ear 111 is provided on each of the top and bottom side edges of the mechanism plate 61. Referring to FIGS. 15 and 20, each ear 111 has a rearwardly facing surface which bears against the side of one of the cover ribs 91 to urge the cover rearwardly relative to the mechanism plate to hold the tabs 93 and 101 against the edges of their respective openings 98 and 108.

While the cover 81 is easy to assemble to the mechanism plate 61, it is not easy to disassemble. The tabs 93 and 101 are only accessible through the respective female connectors 90 and 100 from the drive drum side of the mechanism plate. This arrangement allows facile assembly while detering tampering.

Referring to FIGS. 17 and 20, the side wall 82 of the particular cover 81*a* for the unmetered crank mechanism module 3*a* has a hole 112 which is aligned with the drive gear 68 when the cover is assembled to the mechanism plate 61. A crank 113 fits into the hole 112 to secure the gears to the mechanism plate 61. The crank 113 has a locking fork 114 which extends through the stub sleeve 69 and locks over the shoulder which connects the stub sleeve to the larger diameter sleeve 70 so that the crank 113 is rotatable relative to the stub sleeve. The inside surface of a disc portion 115 of the crank 113 has protrusions 116 which fit into recesses in the drive gear 68 to provide a driving connection between the crank 113 and the drive gear. The disc 115 is supported by an annular lip 117 of the cover 81 so that it is flush with the exterior of the cover. A crank handle 118 protrudes at a right angle from the outer periphery of the disc 115 to provide a means for a user to rotate the crank to operate the dispenser.

The construction of the drive train of the unmetered crank mode of the mechanism module has now been fully described. It is the simplest mode, requiring the fewest parts. However, out of personal preference or to conserve paper, other modes such as an unmetered lever, a metered crank or a metered lever mode may be desirable. The drive train constructions which produce these modes are described below. As will be pointed out, much of the description of the construction of the unmetered crank mode applies equally to the other modes and will not be repeated.

(b) Unmetered Lever Mode

Figure 27:
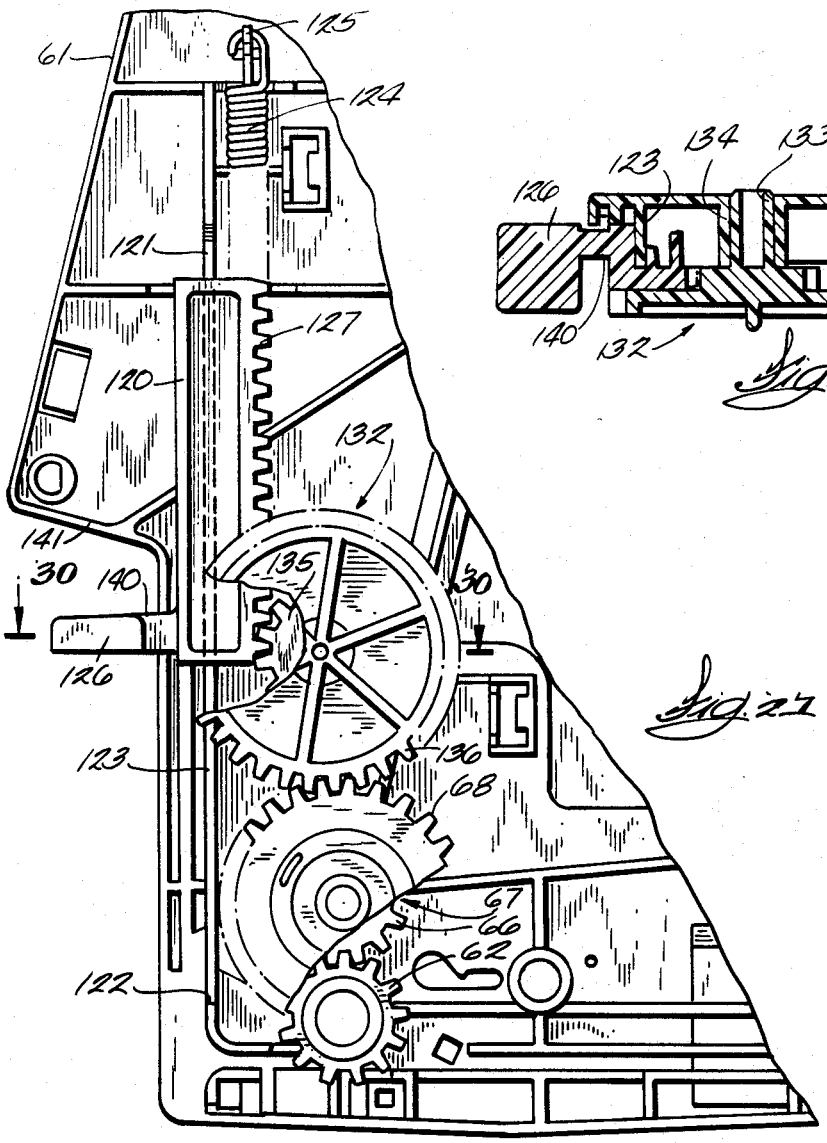
FIG. 27 is a fragmentary view with portions broken away of a second embodiment of a mechanism module which is constructed to provide an unmetered lever mode of operation.

The drive train of an unmetered lever mode mechanism module 3b is shown in FIG. 27. In this mode, the user operates the dispenser with a vertical translatory motion to dispense a length of paper towel.

The mechanism module 3b is constructed with the same mechanism plate 61 as the unmetered crank mode mechanism module 3a. The drive pinion 62 and the overrunning clutch 67 can also be the same and can be assembled to the mechanism plate 61 in the same fashion.

The mechanism module 3b further includes a rack 120 which is molded in one piece from suitable plastic material. The rack 120 is slidably mounted for vertical translatory motion between an upper stop 121 and a lower stop 122 of a slide bar 123 which is molded into the mechanism plate 61 and is best shown in FIG. 15. An extension spring 124 is connected between the rack 120 and a finger 125 of the mechanism plate 61 to bias the rack upwardly. The rack 120 has a handle 126 to be pushed by a user and teeth 127 to interface the rest of the drive train to thereby give the user a means to rotationally drive the drive roll 4 to dispense a length of sheet material.

Figure 29:
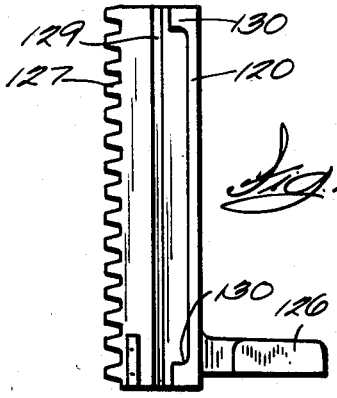
FIG. 29 is a left plan view of the rack of FIG. 28.
Figure 28:
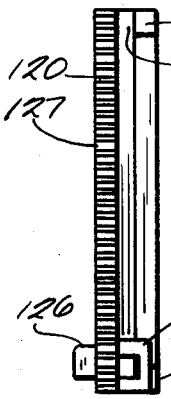
FIG. 28 is a rear plan view of a rack for the mechanism module of FIG. 27.

FIGS. 28 and 29 show the rack 120 apart from the mechanism module 61. A runner 129 which extends over the length of the rack and a pair of rearwardly facing steps 130 on the ends of the rack define a space between them to receive the slide bar. As shown in FIG. 28, a U-shaped connector 131 is formed at the lower end of the rack. The lower end of the extension spring 124 is attached to the connector 131 to bias the rack 120 upwardly.

Figure 30:
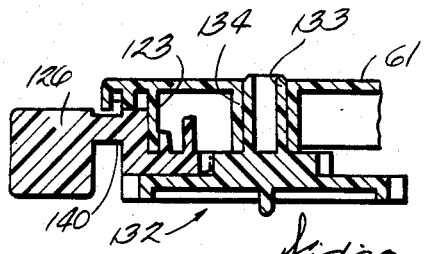
FIG. 30 is a sectional view taken along the plane of the line 30—30 of FIG. 27.

A rack gear 132 couples the rack 120 to the overrunning clutch 67. Referring to FIGS. 27 and 30, the rack gear 132 has an integral shaft 133 which is journaled in a rib reinforced sleeve 134 of the mechanism plate 61. The shaft 133 terminates in an integral rack pinion 135 which meshes with the teeth 127 of the rack 120. The rack pinion 135 is integral with a rack drive gear 136 which meshes with the drive gear 68 of the overrunning clutch 67.

In operation, as the rack 120 is moved downwardly, it drives the rack gear 132 counterclockwise as viewed in FIG. 27. The rack gear 132 drives the drive gear 68 clockwise so that it is fixedly coupled to the clutch gear 66 which therefore also rotates clockwise. This rotates the drive pinion 62 counterclockwise to drive the drive roll 4 to dispense a length of paper towel. On the upward, return stroke of the rack 120, the rack gear 132 is rotated clockwise and the drive gear 68 is rotated counterclockwise. When driven in this direction, the drive gear 68 overruns the clutch gear 66, which remains stationary due to friction in the drive system. The rack 120 thereby returns to the top of its stroke without driving the drive roll 4 backwardly. In the unmetered lever mode, the rack 120 can be continuously reciprocated up and down as many tines as desired to dispense a length of paper towel on every downward stroke.

Figure 31:
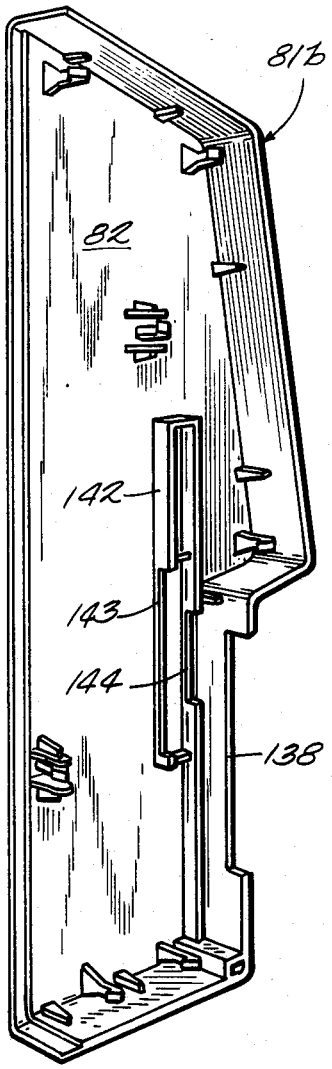
FIG. 31 is a perspective view of a cover for the mechanism module of FIG. 27 as viewed from the rear left side.

A cover 81b specially adapted for the mechanism module 3b is shown in FIG. 31. The description, above, of how the cover 81 is assembled to the mechanism plate 61 applies here, ad will not be repeated. However, a few particulars of the cover 81b which are necessary to accommodate the unmetered lever mode should be noted. The cover 81b has a cut-away portion 138 in its front wall 84 which is opposite a cut-away portion 139 (see FIG. 15) in the mechanism plate 61. These cut-aways are sized to receive a neck 140 (FIG. 30) of the rack handle 126. It is also noteworthy that the handle 126 is positioned below a lip 141 of the mechanism module so as to protect it against violent blows by the user.

In the lever mode, the cover 81b serves to hold the gears and the rack in place. The side wall 82 of the cover abuts the gears to keep them in position. A raised rib structure 142 is provided on the side wall 82 to bear against the side of the rack 120 as the rack is reciprocated. The rib structure 142 is cut out as shown at 143 and 144 to allow clearance for the rack drive gear 136.

(c) Metered Crank and Lever Modes

Figure 33:
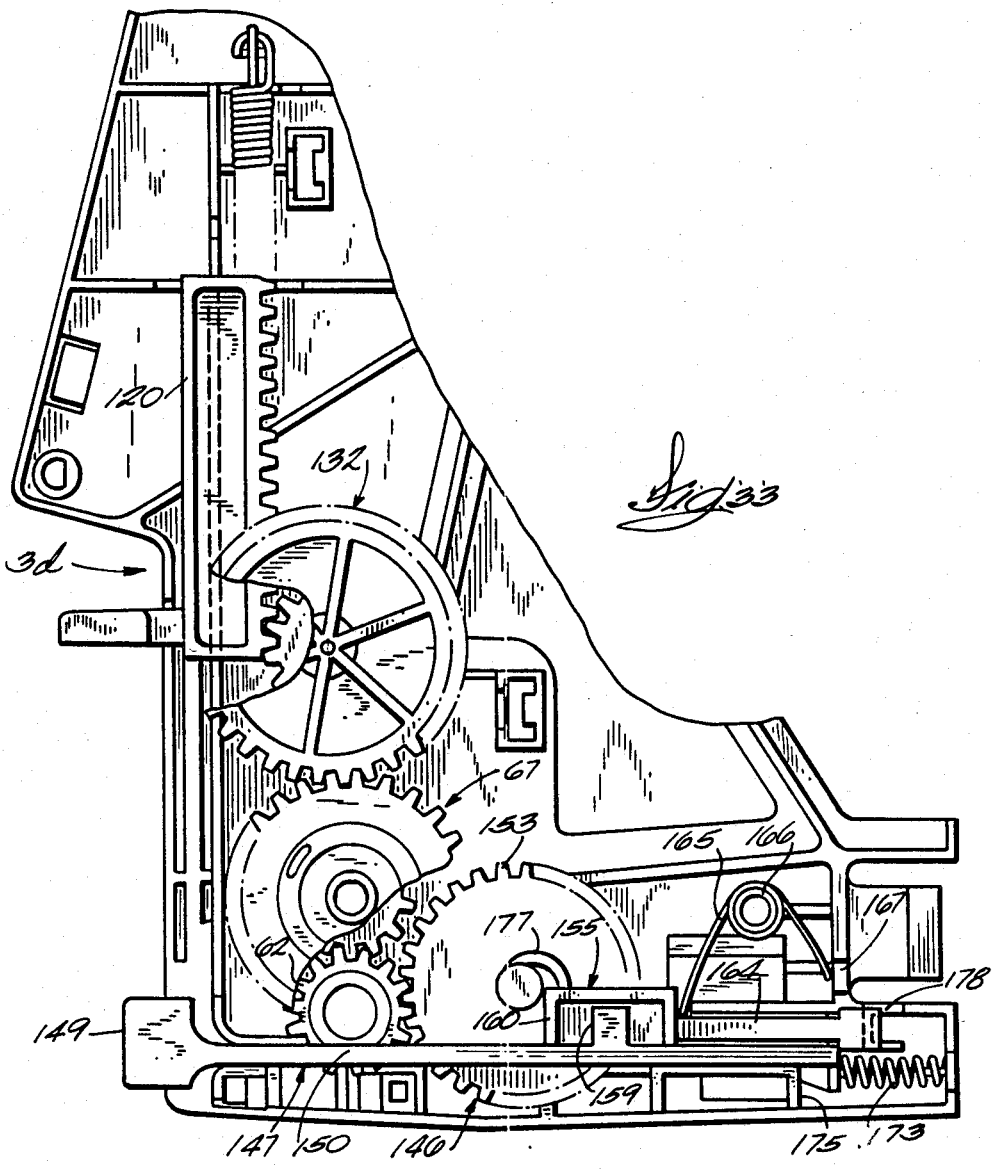
FIG. 33 is a fragmentary view with portions broken away of a fourth embodiment of a mechanism module which is constructed to provide a metered lever mode of operation.

Both the crank and the lever mode drive trains can be made metered by incorporating additional mechanism comprising the metering assembly 146 shown in FIGS. 32 and 33, respectively. In the metered mode, the user must press a button before rotating or reciprocating the respective crank 113 or rack 120 to dispense a length of sheet material. Even then, only a limited number of turns or pumps are allowed before the button must be pressed again to continue dispensing. One pressing of the button allows a length of sheet material to be dispensed which is adequate for the normal person to dry his or her hands. Any more dispensed sheet material usually would only result in waste. The metered feature therefore introduces an impediment against excessive dispensing to deter waste of sheet material.

Figure 34:
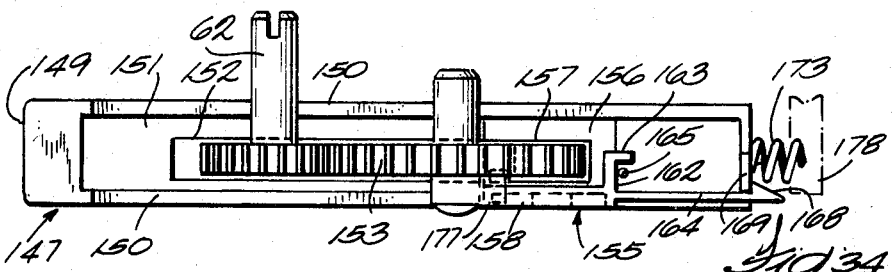
FIG. 34 is a top view of the metering assembly portion of the mechanism modules of FIGS. 32 and 33 shown together with the drive pinion.
Figure 35:
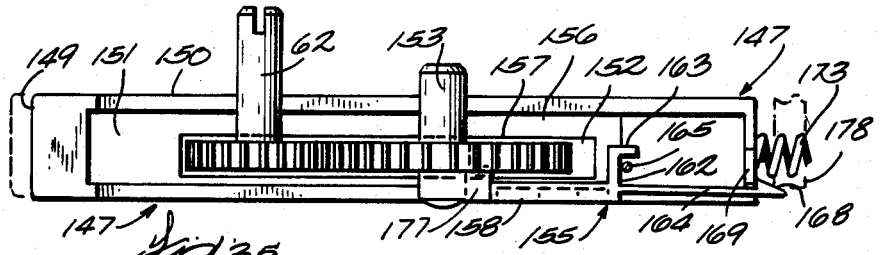
FIG. 35 is a view similar to FIG. 34 but shown with the metering release in a depressed position.
Figure 36:
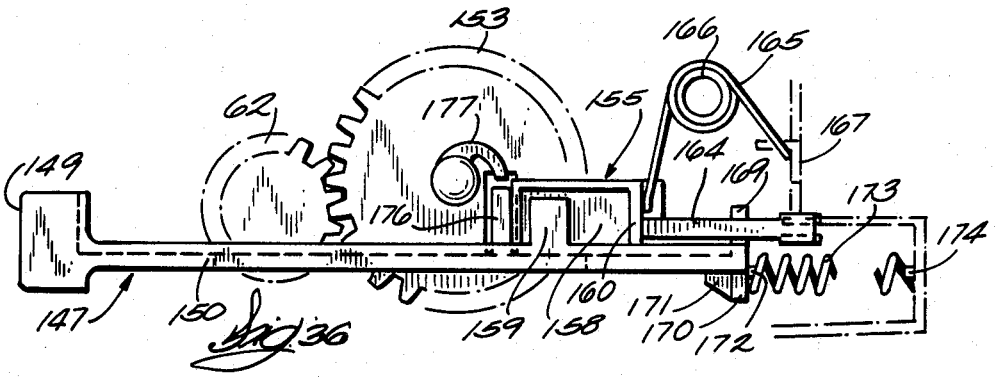
FIG. 36 is a side view of the mechanism shown in FIGS. 34 and 35 but in a released position.

For clarity, FIGS. 34, 35 and 36 show only the drive pinion 62 together with the components of the metering assembly 146. The metering assembly 146 can be added to either of the above described mechanism modules 3a or 3b to change its mode from being unmetered to being metered. The descriptions of the drive trains of the unmetered mechanism modules 3a and 3b therefore apply equally to the drive train of the respective metered mechanism modules 3c and 3d described below, except as otherwise stated.

The metering assembly 146 has a metering release 147 which is molded of suitable plastic and is slidably disposed in a channel 148 (FIG. 15) of the mechanism plate 61. It includes a button 149 at the front and a rectangular body 150 which extends rearwardly from the button. As best shown in FIGS. 34 and 35, the interior 151 of the body is recessed and includes a slot 152 in which the lower portions of the drive pinion 62 and a metering gear 153 are disposed. The drive pinion 62 is journaled in the mechanism plate as previously described and the metering gear is journaled in a rib reinforced sleeve 154 (FIGS. 15 and 38) of the mechanism plate 61. The slot 152 is wide enough to allow the drive pinion 62 and the metering gear 153 to rotate freely and long enough to avoid interference with the gears in all positions of operation.

A release stop 155 which is molded from a suitable plastic such as nylon is slidably received in the interior 151 of the body 150 near the rear of the slot 152. The release stop 155 has a base 156 which extends across the width of the recessed interior 151 and has a forwardly opening slot 157 which is aligned with the slot 152 and in which the metering gear 153 is disposed and can rotate freely. A stop wall 158 extends upwardly along the outside edge of the base 156 and is restrained against outward movement by a support tab 159 which extends upwardly from the edge of the metering release 147 and abuts the stop wall 158. The sides of a raised rim 160 on the stop wall 158 provide outer limits for the sliding motion of the release stop 155 relative to the metering release 147.

The rear portion of the stop wall 158 and the raised rim 160 are integral with a rear wall 162 which projects upwardly from the rear of the base 156. A tab 163 and a cantilever spring catch 164 project rearwardly from the rear wall 162 to define a space between them on the rear wall in which one end of a torsion spring 165 which is mounted on a sleeve 166 (FIGS. 15, 32, 33 and 36) of the mechanism plate 61 is disposed. The other end of the torsion spring 165 presses against a wall 167 of the mechanism plate. The spring catch 64 has a ramped end 168 which, as shown in FIGS. 34 and 35, is normally caught behind a tab 169 which extends upwardly from the rear edge of the metering release 147. Extending downwardly from the rear edge of the metering release 147 is a rear wall 170 which is reinforced by a fillet 171 and which has a stub 172 on its rear surface. The stub 172 captivates one end of a compression spring 173 which has its other end captivated by a stub 174 (FIGS. 32, 33 and 36) on the mechanism plate 61. The forward edge of the rear wall reinforcing fillet 171 abuts an edge 175 of the mechanism plate 61 to limit the forward movement of the metering release 147.

Figure 37:
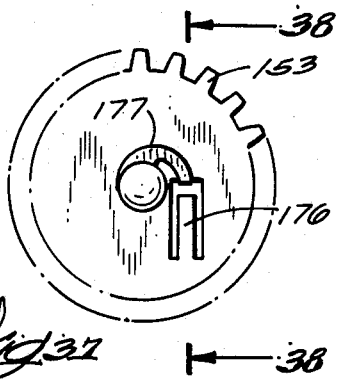
FIG. 37 is a detail view of a metering gear for the metering assembly of FIGS. 34–36.
Figure 38:
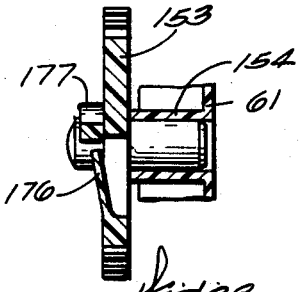
FIG. 38 is a sectional view taken along the plane of the line 38—38 of FIG. 37 showing the mounting of the metering gear in the mechanism plate.

To dispense a length of sheet material, a user must first depress the button 149 to move the metering release 147 and the release stop 155 backwardly against the forward biasing forces of the springs 165 and 173. Referring to FIGS. 37 and 38, the metering gear 153 has a spring finger 176 at the end of a cam portion 177. When the button 149 is depressed about as far as shown in FIG. 35, the stop wall 158 of the release stop 155 is moved past the spring finger 176 so that the spring finger 176 snaps outwardly. When the button 149 is pushed a little further rearwardly than shown in FIG. 35, the ramped end 168 of the spring catch 164 is released from being caught behind the tab 169 by a projection 178 of the mechanism plate 61 and the release stop 155 is urged forwardly against the side of the spring finger 176 by the torsion spring 165 as shown in FIG. 36. The projection 178 also serves as a stop which the tab 169 abuts to limit the rearward movement of the metering release 147. When the button 149 is released, the spring 173 urges the metering release 147 forwardly to its starting position, also as shown in FIG. 36.

In the position of the release stop 155 shown in FIG. 36, the metering gear 153 and therefore the drive pinion 62 are free to rotate to dispense a length of sheet material. As usual, the drive pinion 62 rotates counterclockwise as the user cranks or pumps the dispenser. The metering gear therefore rotates clockwise. Also, as in the other modes, reverse rotation is prevented by the overrunning clutch 67. As the metering gear 153 is rotated clockwise, the release stop 155 follows the outer surface of the cam portion 177. In about the last quarter of rotation of the metering gear 153, the inside surface of the stop wall 158 engages the outside surface of the spring finger 176 and presses the spring finger 176 back into the plane of the metering gear 153. After one full revolution of the metering gear, the end of the cam portion 177 abuts the top of the stop wall 158 so that the metering gear 153 and the drive pinion 62 are stopped in their rotation. If the user desires more sheet material, he must press the button 149 again to release the metering gear 153 to make another revolution.

The relative sizes of the drive roll 4, the drive pinion 62 and the metering gear 153 are such that one revolution of the metering gear 153 is sufficient to dispense a length of sheet material which is adequate for the normal user. While the projection 178 prevents the user from holding the release stop 155 backwardly and therefore prevents unmetered operation, the user can always dispense more sheet material by repeatedly depressing the button and dispensing. However, this procedure discourages wasteful use of sheet material.

Figure 39:
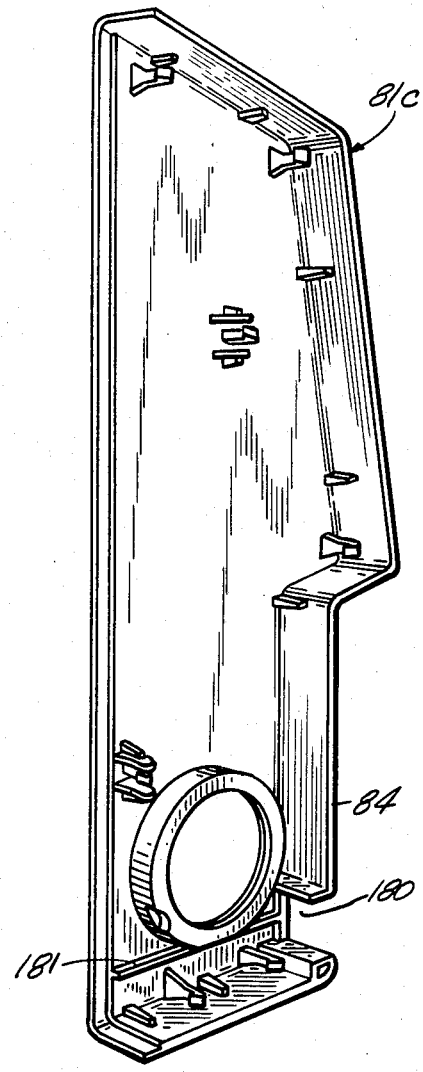
FIG. 39 is a perspective view of a cover for the metered crank mode mechanism module of FIG. 32 as viewed from the rear left side.
Figure 40:
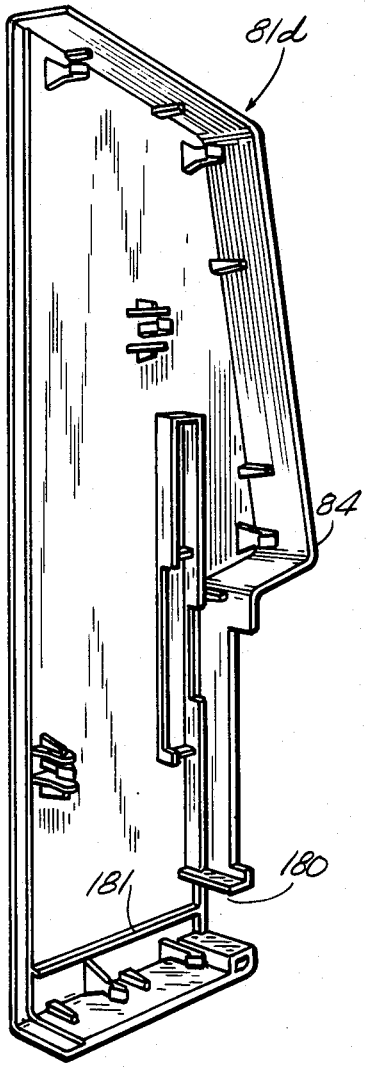
FIG. 40 is a perspective view of a cover for the metered lever mode mechanism module of FIG. 33 as viewed from the rear left side.

The covers 81*c* and 81*d* for the metered crank mechanism module 3*c* and for the metered lever mechanism module 3*d*, respectively, are basically the same as the covers 81*a* and 81*b* for the respective unmetered mechanism modules 3*a* and 3*b* but have additional features to accommodate the metering assembly 146. As shown in FIGS. 39 and 40, a rectangular cut-out 180 is provided on the front wall of each cover 3*c* and 3*d* which is aligned with the push button 149 when the cover is assembled to the mechanism plate 61. The button 149 protrudes from the cover and the periphery of the cut-out 180 is reinforced. Also, a rib 181 is provided which is aligned with the side edge of the metering release 147 to hold the metering release in the channel 148.

All of the modes of operation and the assembly of a mechanism module to produce each mode have now been fully described. It should be apparent that many parts are common to all the modes and that assembly of any mechanism module is very simple. It should also be apparent that the only variable element among dispensers exhibiting different modes of operation is the mechanism module so that all of the other elements of a dispenser are common to all the dispensers, regardless of the mode of operation.

(d) Assembly of Back and Module

Figure 5:
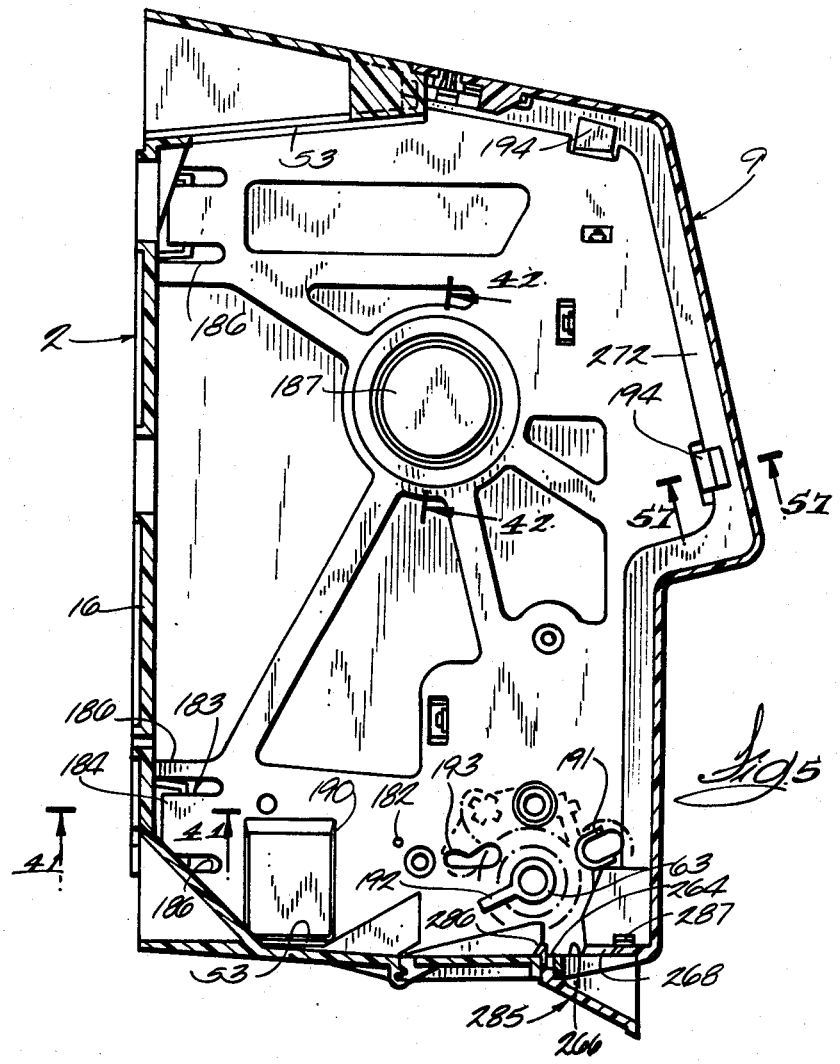
FIG. 5 is a sectional view taken along the plane of line 5—5 of FIG. 1.
Figure 41:
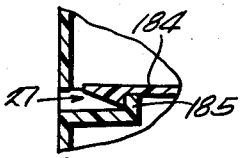
FIG. 41 is a sectional view taken along the plane of the line 41—41 of FIG. 5.

The various mechanism modules are all assembled to the back in the same way. The rear portions of the upper and lower sides of the mechanism plate 61 are slid rearwardly between the pair of wedge ribs 53 on the guide wall 44 and the pair of wedge ribs 53 on the bottom wall 20. The wedging action of the ribs 53 against the mechanism plate 61 holds the mechanism module securely against any lateral movement. A pair of connectors 183 are provided at the rear of the mechanism plate which cooperate with the locking structures 27 on the back. Referring to FIG. 41, each connector 183 has a locking tab 184 which snaps behind a foward wall 185 of the locking structure 27. As best shown in FIG. 5, stops 186, one being on each side of each tab 184, abut the rear wall 16 of the back 2. The tabs 184 hold the mechanism module securely between the wedge ribs 53 and are positioned so that they are difficult to release when the dispenser is mounted on a wall to deter tampering. Also, as best shown in FIGS. 1-3, the rear edges of the mechanism module cover 81 overlap the forward edges of the back 2 for strength and to seal the interior of the dispenser from the exterior.

Figure 42:
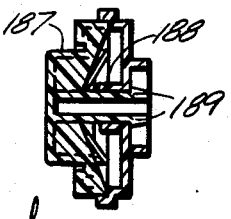
FIG. 42 is a sectional view taken along the plane of the line 42—42 of FIG. 5.

Referring to FIGS. 5 and 14, the drive roll side of the mechanism plate 61 performs a variety of functions. A reserve roll hub 187 is rotatably mounted in a recessed hole to a sleeve 188 by means of integral locking forks 189 as best shown in FIG. 42. The reserve roll hub 187 supports the right hand end of the reserve roll R and rotates as the reserve roll R is depleted. A raised surface 190 on the mechanism plate abuts the right hand end of the primary roll P to keep it in position as it is consumed. A hole 182 is provided through which the right hand end of the rod 12 extends. An oblong depression 191 with a longitudinal axis along a diametral line of the sleeve 63 is forward of the sleeve 63 and a spring retaining rib 192 lies along the same diametral line rearward of the sleeve 63. A hole 193 is also provided having an enlarged portion, a narrower slot portion and a tooth between the two portions. A door guide 194 is provided on each of the upper, lower and forward edges of the mechanism plate 61 to receive and stiffen the door as described below.

(3) The Feed Roll Support Arm

Figure 44:
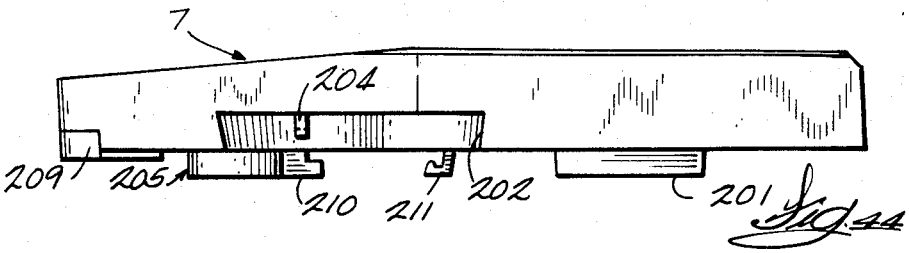
FIG. 44 is a top plan view of the feed roll support arm of FIG. 43.
Figure 43:
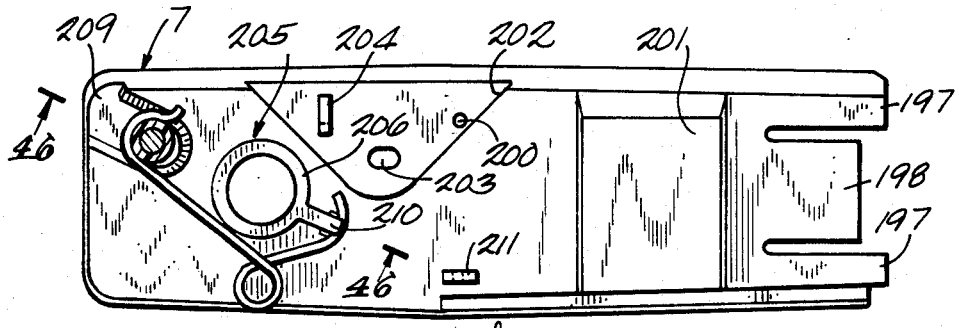
FIG. 43 is a right side plan view of a feed roll support arm for the dispenser of FIG. 4.
Figure 45:
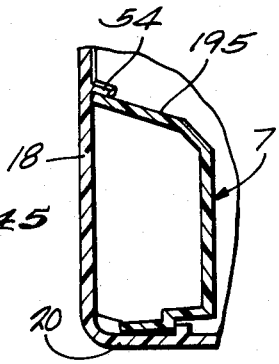
FIG. 45 is a sectional view of the feed roll support arm mounted to the back taken along the plane of the line 45—45 of FIG. 4.
Figure 47:
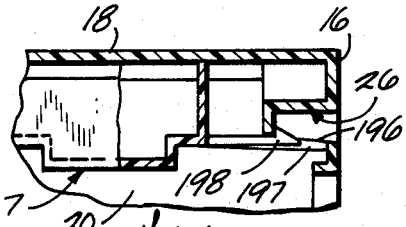
FIG. 47 is a sectional view of the feed roll support arm mounted to the back taken along the plane of the line 47—47 of FIG. 4.

Referring to FIGS. 43 and 44, the feed roll support arm 7 is molded in one piece from a medium impact ABS or other suitable plastic and is assembled to the lower left corner of the back by sliding it between the wedge ribs 54 and 55. As best shown in FIG. 45, the arm 7 has an angled top wall 195 which conforms to the downwardly angled wedge rib 54. This, together with the wedge rib 55, provides a wedging action as the arm 7 is slid into place to hold the arm snugly against the left side and bottom walls 18 and 20, respectively. Referring to FIGS. 11 and 47, faces 196 of the locking structure 26 are angled to engage walls 197 of the arm 7 as it is slid rearwardly to provide a secondary wedging action from rear to front. As best shown in FIG. 47, the arm 7 has a locking tab 198 between the walls 197 which snaps behind a web 199 of the locking structure 26 to hold the arm 7 in its wedged position. As with the mechanism module locking structures 27, the locking tab 198 and the locking structure 26 of the drive drum support arm are difficult to disassemble when the dispenser is mounted on a wall to deter tampering.

Figure 46:
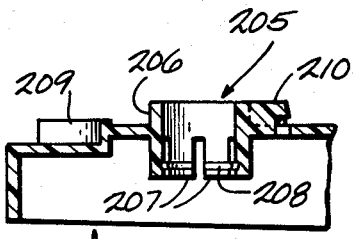
FIG. 46 is a sectional view taken along the plane of the line 46—46 of FIG. 43.

The feed roll support arm 7 has a raised face 201 to abut the left end of the primary roll P and hold it in its proper axial position. An upwardly opening V-shaped recess 202 forward of the raised face 201 includes a hole 200 through which the rod 12 extends and an oblong hole 203. The end of the rod 12 on the outer side of the arm 7 can be bent to keep it from rotating. A spring retaining rib 204 which defines a downwardly opening notch is formed on the side wall of the recess 202 forward of the hole 203. As best shown in FIGS. 43 and 46, the arm 7 has a drive roll pin locking structure 205 having a ring portion 206 and a plurality of flexible locking tabs 207 that define an inner annular groove 208. The arm 7 also includes an upwardly opening oblong depression 209 which has a longitudinal axis along a diametral line of the drive drum pin locking structure 205. Also, a spring retaining rib 210 is provided which is similar to the spring retaining rib 191 of the mechanism plate 61.

Lastly, with respect to the feed roll support arm, a hinge pin locking structure 211 is provided on the lower portion of the feed roll support arm which is adjacent to the edge of the back 18 when the arm 7 is mounted to the back. The hinge pin locking structure is open at the front and has a tooth at its front end so that it is suitable to receive the diameter of the hinge pin and lock it in the space behind the tooth.

(4) The Delivery Mechanism

The delivery mechanism comprises the drive roll 4, the idler roll 5 and the transfer bar 6. Apart from a few metal springs and a metal hinge pin, the drive and idler rolls are the only non-plastic parts of the dispenser. They are made of wood and the drive drum 4 is preferably coated with an abrasive material, such as sand, to positively engage the paper web.

Figure 48:
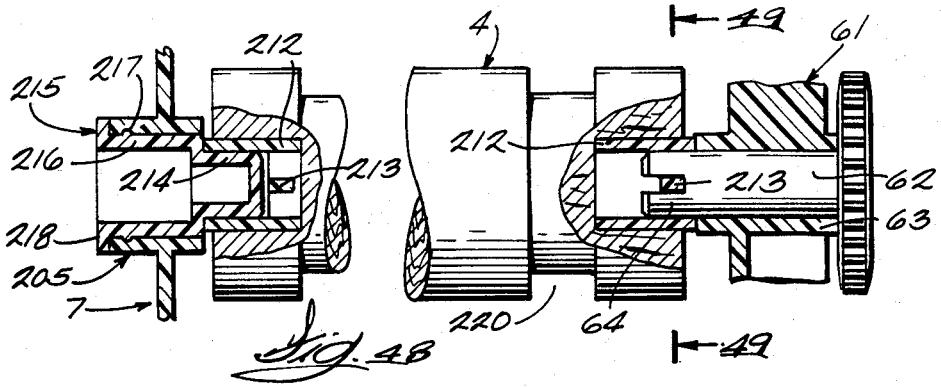
FIG. 48 is a fragmentary view partially in section of the drive roll and associated mounting structure.
Figure 49:
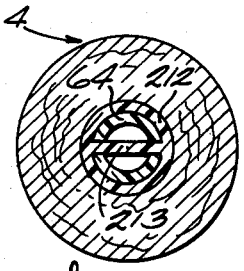
FIG. 49 is a sectional view taken along the plane of the line 49—49 of FIG. 48.

Referring to FIG. 48, the left end of the drive roll 4 has a bore into which is pressed or otherwise securely fastened a nylon insert 212 having a web 213 at its innermost end which spans its inside diameter. The inside diameter of the insert 212 is sized to receive a stub shaft 214 of a plastic drive drum pin 215 to provide a bearing fit so that the drive drum can rotate freely relative to the drive drum pin. The drive drum pin 215 has a larger diameter portion 216 with a circumferential ridge 217 and a flange 218 at its outer end. The pin 215 is inserted into the drive roll pin locking structure 205 of the drive roll support arm 7 and the annular groove 208 snaps over the ridge 217 to lock the pin 215 in place as shown in FIG. 48. The outer diameter of the drive roll 4 has circumferential grooves 220 and the right end of the drive roll also has an axial bore with an identical nylon insert 212 secured therein. The insert 212 in the right end of the drive roll 4 is installed with its web 213 at the outermost end of the bore so that it is engageable by the end 64 of the drive pinion 62 as best shown in FIG. 49. The drive pinion 62 drives and supports the right end of the drive roll 4 and is shown in FIG. 48 mounted in the sleeve 63 of the mechanism plate 61.

Figure 50:
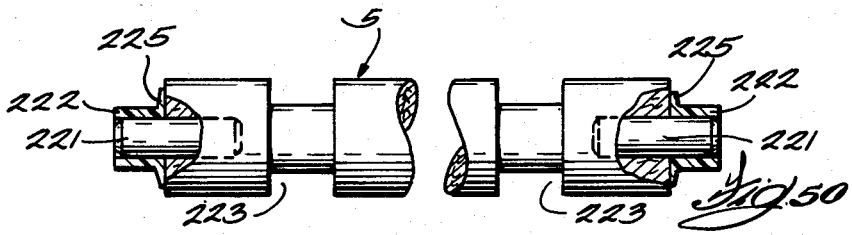
FIG. 50 is a fragmentary view partially in section of the idler roll.

As best shown in FIG. 50, each end of the idler roll 5 has an axial bore into which is pressed a steel stud 221. The studs 221 project out of the ends of the idler roll and are journaled in nylon bushings 222 each having a radial flange 225. The outside diameter of the idler roll 5 has circumferential grooves 223 which are aligned with the grooves 220 of the drive drum 4. The right end of the idler roll, via stud 221 and bushing 222, is supported by the oblong depression 191 in the mechanism plate 61 and the left end is supported in the depression 209 in the feed roll support arm 7. The ends of the idler roll 5 are biased toward the drive roll 4 by a pair of torsion springs 224 (see FIG. 43), each of which hooks over one of the nylon bushings 222 and is retained by one of the spring retaining ribs 210 and 192 on the feed roll support arm 7 (shown) and the mechanism plate 61 (not shown), respectively. Biasing the idler roll 5 against the drive roll 4 ensures that the sheet material web in the nip between the drive and idler rolls will be positively engaged by the drive roll.

Figure 51:
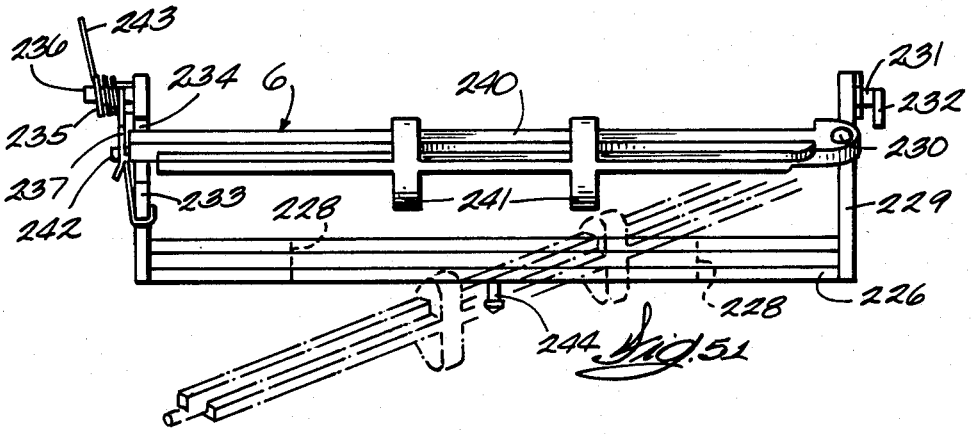
FIG. 51 is a front plan view of the transfer bar.
Figure 53:
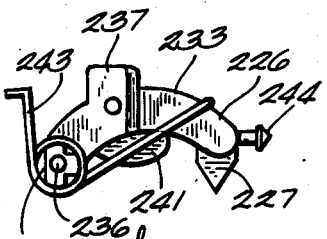
FIG. 53 is a left side plan view of the transfer bar of FIG. 51.
Figure 52:
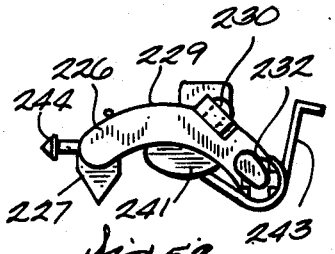
FIG. 52 is a right side plan view of the transfer bar of FIG. 51.

The transfer bar 6 of FIGS. 51–53 is molded in two pieces from plastic material. A wedge bar 226 has a centrally located transfer wedge 227, the ends of the transfer wedge being indicated by the broken lines 228 in FIG. 51. The transfer wedge 227 is aligned with the nip between the drive and idler rolls when the delivery mechanism is assembled. As shown in FIG. 52, the right hand end of the wedge bar 226 has an arcuate side section 229 having a mushroom headed post 230 on its top wall and a trunnion 231 at the end of the side section 229 which has a lobe 232 at its end. The left hand end of the wedge bar 226 (FIG. 53) also has an arcuate side section 233. The side section 233 has a cutout portion 234 which is transversely aligned with the post 230 of the right side section 229. A foundation 235 projects from the end of the side section 233 and has a trunnion 236 at its end. A spring arm 237 projects forwardly from the foundation 235 parallel to the side section 233 and has a hole transversely aligned with the post 230.

The second piece of the transfer bar 6 is a cam bar 240 which has two cam lobes 241, each of which is aligned with an annular groove 220 in the drive roll 4. The right end of the cam bar 240 has a hole sized to fit over the mushroom head of the post 230 and snap into place for a hinged connection. The left end of the cam bar 240 has a post 242 which is captivated by the hole in the spring arm 237 when the cam bar 240 is swung into position. Preferably, the spring arm 237 has an outwardly inclined forward edge and a guide rib on its inside surface to guide the post 242 into alignment with the hole in the spring arm for each positioning of the cam bar. The cam bar 240 is easily released by the spring arm 237 to be swung out of the way (shown in phantom) for easy threading of the paper webs when the dispenser is being refilled.

The transfer bar 6 is installed with the left trunnion 236 journaled in the hole 203 in the drive drum support arm 7 and with the right trunnion 231 journaled in the hole 193 in the mechanism plate 61. The lobe 232 fits into the larger portion of the hole 193 and the trunnion 232 is then slid backwardly into the narrower slot portion of the hole 193 until its snaps behind the tooth of the hole 193. This arrangement deters tampering because it makes the transfer bar difficult to remove when the drive roll is in position. A torsion spring 243 winds around the foundation 235 and has one end hooked over the side section 233 and the other end captivated by the notch in the spring retaining rib 204 in the feed roll support arm 7 to bias the transfer wedge 227 down into the nip between the drive and pinch drums. A knob 244 is provided at a forward central location on the wedge bar 226 to provide a handle to easily lift the transfer wedge 227 out of the nip between the drive and pinch drums to facilitate refilling the dispenser. As previously stated, the operation of a delivery mechanism similar to the one described above is fully described in the Hedge et al U.S. Pat. No. 4,165,138.

(5) The Reserve Roll Support Arm

Figure 55:
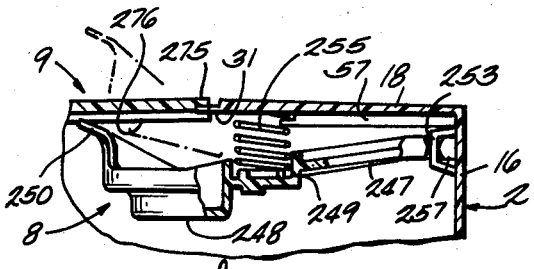
FIG. 55 is a sectional view taken along the plane of the line 55—55 of FIG. 4 with portions broken away.
Figure 54:
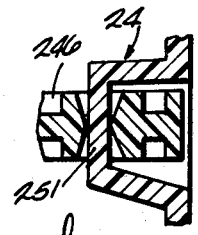
FIG. 54 is a sectional view taken along the plane of the line 54—54 of FIG. 4.

Referring to FIG. 4, the reserve roll support arm 8 is molded in one piece from a suitable plastic such as medium impact ABS. It includes a hook mounting leg 246, a locking leg 247, a reserve roll hub 248, and a thumb handle 250. The hook mounting leg 246 has a C-shaped opening which faces downwardly near its end for hooking over a web 251 of the locking structure 24. As shown in FIG. 54, the two opposing faces of the C-shaped opening in the leg 246 are V-shaped with sides angling outwardly from the center of the opening to provide a knife edge hinge joint which allows the arm 8 to pivot freely. Similarly, FIG. 55 shows that the opposing faces of an opening in the locking leg 247 are V-shaped to allow for free pivoting of the arm. Additionally, a tongue 257 (FIG. 4) forms one face of the locking leg opening and is resilient to allow easy assembly of the arm 8 to the back 2. The arm is simply attached to the back by first hooking the mounting leg 246 over the web 251 of the locking structure 234 and then swinging the arm 8 downwardly so that the end of the locking leg 247 enters the locking structure 25 until the tongue 257 snaps behind a web 253 of the locking structure 25 to captivate the web 253 in the locking leg opening. The locking structures 24 and 25 also have angled walls to allow clearance for the arm 8 to pivot. Again, once the arm is assembled to the back 2 and the back is mounted to a wall, it is very difficult to disassemble the arm from the back to prevent tampering.

Referring to FIG. 55, an annular groove 249 formed in the backside of the arm 8 is dimensioned to captivate one end of a compression spring 255. The compression spring 255 extends from the annular groove 249 to the left side wall 18 of the back and is held in place on the left side wall by the spring retaining rib 57. The hub 248 is sized to fit within the core of the reserve roll R so that the reserve roll is supported between the two hubs 248 and 187 on the reserve roll support arm 8 and on the mechanism plate 61, respectively. When a reserve roll is to be replaced, the door 9 is swung out of the way and the arm 8 is swung outwardly by means of the thumb handle 250, as shown in phantom in FIG. 55, until the hub 248 clears the old roll. The core of the old roll is then removed and is replaced with a new roll. It should be noted that the hub 248 does not rotate. This provides a certain amount of friction which is desirable for the proper operation of the delivery mechanism.

(6) The Door

Referring to FIG. 1, the door 9 forms the left portion of the front of the dispenser cabinet. Like the rest of the cabinet, it is molded in one piece from a suitable plastic material, such as, for example, high impact ABS.

Figure 6:
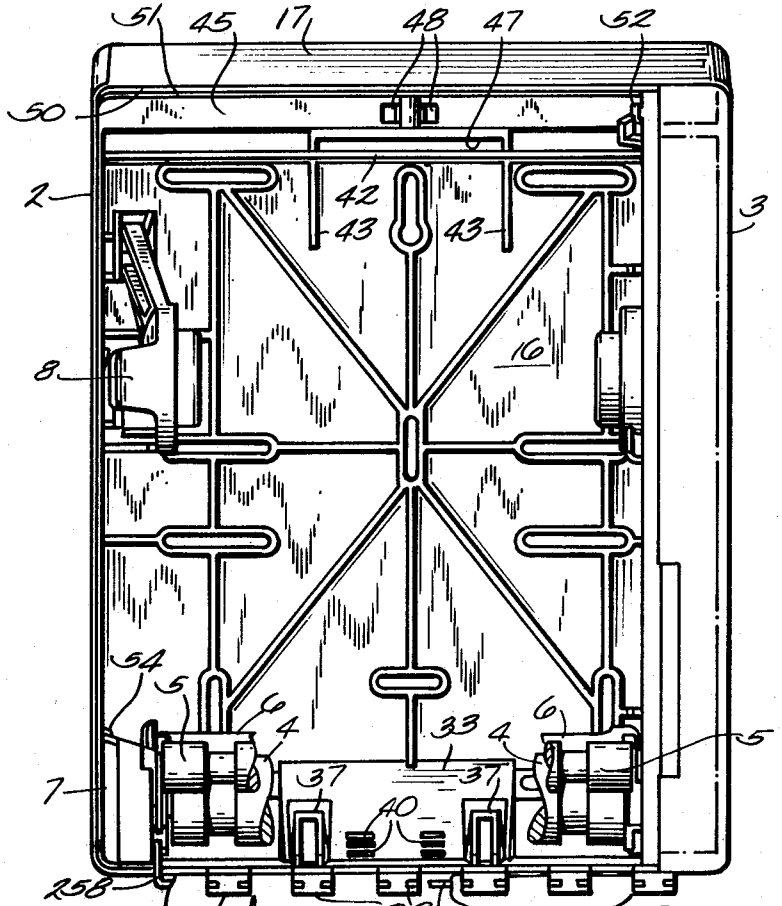
FIG. 6 is a front plan view shown with the door open and with portions broken away.

Referring to FIGS. 2 and 3, the door 9 is hingedly connected to the back 2 by hinge elements 257 which are molded into the door and are spaced apart to interdigitate with the hinge elements 38 of the back. A metal hinge pin 258, a portion of which is shown in FIG. 6, is inserted through the hinge elements 257 and 38. The left end of the hinge pin is bent at a right angle and is rotated up into the space defined by the hinge pin locking structure 211 in the feed roll support arm 7 to inhibit removal of the hinge pin when the door is closed as best shown in FIGS. 4 and 6. Ribs 259 and 260 reinforce the hinge elements 257, with ribs 260 extending forwardly to reinforce the bottom wall 261 of the door 9. The forward ends of the interior ribs 260 are integral with a lateral rib 262 and the end ribs 260 continue forwardly but taper as shown in FIG. 4. Another lateral rib 263 is spaced a short distance forward of the lateral rib 262 and four spaced apart apertures 264 are formed between the ribs 262 and 263. Also, an aperture 265 is formed adjacent to the forward end of each one of the end ribs 260.

An open space 266 for the sheet material web to exit the dispenser is formed between the lateral rib 263 and a plurality of teeth 268 which are molded into the door. Some of the teeth are larger than others and the upper and lower surfaces of the teeth taper to a point (FIG. 4) for enhanced cutting action. As best shown in FIGS. 3 and 4, the bottom wall 261 of the door has four triangular stripper ribs 269 which are rearward of the opening 266 and four rectangular stripper ribs 270 which are forward of the opening. The foward upper corner of each stripper rib 269 is disposed in one of the drive roll grooves 220 to strip any sheet material adhering to the drive roll off the roll as it is rotated and to direct the sheet material out of the dispenser through the opening 266. Similarly, the rearward, upper corner of each stripper web 270 fits into one of the idler roll grooves 223 to strip the sheet material off the idler roll and, if necessary, to direct it through the opening 266.

The front wall 271 of the door is formed so that the upper portion is deeper than the lower portion to accommodate the reserve roll R. A flange 272 is spaced a short distance inward from the right edge of the door and extends over the entire length of the front wall, onto the bottom wall 261, and onto the top wall 273. The top end of the flange 272 defines a nose 272*a*. The left side wall 274 has an inside rearward edge 275 which is defined by a recess and has a pair of reinforcing ribs 276, the ends of which extend over the edge 275 to form a space between the edge 275 and the ribs 276. The recess defining the edge 275 continues a distance onto the bottom wall 261 up to the first hinge element 257 to define a recessed edge 277 on the bottom wall.

The top wall 273 is angled to conform to the angled top walls of the back and the mechanism module and also has a centrally located hole 280 to provide key access to a lock 281. Referring to FIG. 56, the inside surface of the top wall 273 has a pair of shoulder ribs 282 and a pair of wedge structures 283 arranged symmetrically on each side of the hole 280. The shoulder ribs 282 and the wedge structures 283 are provided to mount the lock 281, which is described below.

An optional plastic deflector 285 is shown in FIG. 5 mounted to the door 9 over the opening 266. The deflector 285 is mounted to the door by four tabs 286 at its rearward edge which snap into the apertures 264 and by a pair of tabs 287, one tab 287 being on the forward portion of each side edge of the deflector, which snap into the apertures 265. The deflector opens toward the front of the dispenser to direct sheet material at an angle away from the opening as it is dispensed. The deflector 285 thereby prevents a user from overriding the drive mechanism by pulling the sheet material through the nip between the drive and idler rolls since any such attempt would result in the sheet material being cut by the teeth 268.

Figure 57:
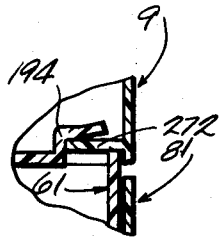
FIG. 57 is a sectional view taken along the plane of the line 57—57 of FIG. 5.

The door 9 cooperates with the back 2 and the mechanism module 3 to add strength to the dispenser cabinet when the door is closed. When the door is closed, the top, bottom and left side edges of the door overlap the corresponding top, bottom and left side edges of the back. Referring to FIGS. 4 and 55, the left side edge 31 of the back extends into the spaces between the ribs 276 and the left side edge 275 of the door so that the door is restrained against lateral movement relative to the back. The edge of the top wall of the door abuts the ledge 50 of the top of the back to resist lateral twisting. The flange 272 is received by the door guides 194 as shown in FIGS. 5 and 57 and the nose 272*a* is received by the guide aperture 52 in the back. The right edges of the bottom, front and top walls of the door overlap the mechanism plate 61. This arrangement prestresses the door, the mechanism module and the back to make the dispenser much more rigid with the door closed than with the door open.

(7) The Lock

The lock 281 holds the door shut against the back 2 and against the mechanism module 3. Referring to FIG. 58, the lock is shown assembled to the door 9 and includes a latch 290 and a latch bushing 291. A key 292 is also provided which is fitted to the lock 281. The latch 290, the bushing 291 and the key 292 are all molded of plastic material.

Figure 61:
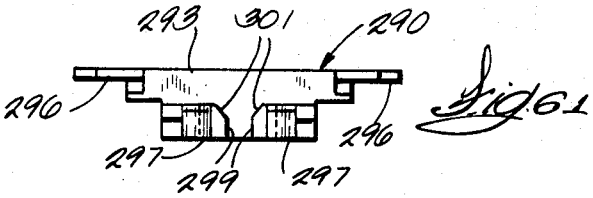
FIG. 61 is a rear plan view of the latch of FIG. 59.
Figure 59:
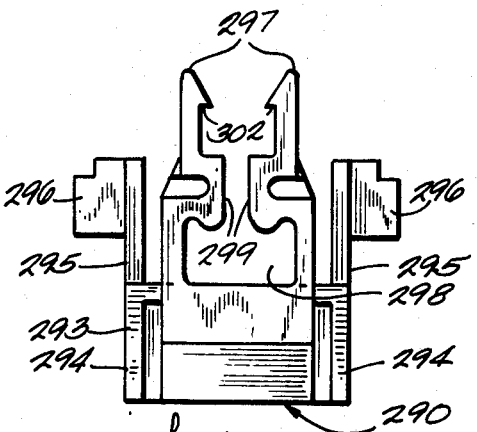
FIG. 59 is a bottom plan view of a latch for the lock of FIG. 58.
Figure 60:
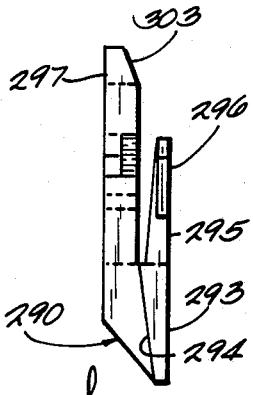
FIG. 60 is a side plan view of the latch of FIG. 59.

Referring to FIGS. 59, 60 and 61, the latch 290 has a mounting base 293 with a pair of rearward ramped portions 294 and a pair of forward retainer arms 295, each having a tab 296 at its forward end. Integral with and extending forwardly above the mounting base 293 is a pair of catches 297. The catches 297 are of a fairly small cross section near their bases, with a rectangular space 298 between them, so that the catches are resilient toward and away from each other. The intermediate sections of the catches 297 define opposed cam surfaces 299 each having a leading edge 301 (FIG. 61) which is beveled. The ends of the catches are ramped to define rearwardly facing shoulders 302 and are also beveled at 303.

Figure 62:
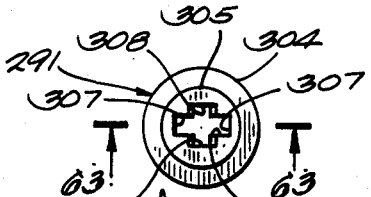
FIG. 62 is a top plan view of a latch bushing for the lock of FIG. 58.
Figure 63:
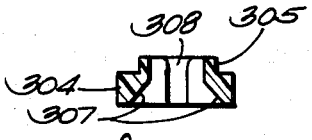
FIG. 63 is a sectional view taken along the plane of the line 63—63 of FIG. 62.

FIGS. 62 and 63 show the latch bushing 291 alone. It has a circular cylindrical portion 305 and a spacer portion 304 which is preferably cylindrical and defines an upwardly facing shoulder with the cylindrical portion 305. A rectangular slot 306 extends through the latch bushing 291 with end walls 307 which are angled outwardly in the spacer portion 304. A pair of opposing recesses 308 are defined in the intermediate portions of the side walls of the rectangular slot 306 which extend all the way through the bushing 291.

Figure 64:
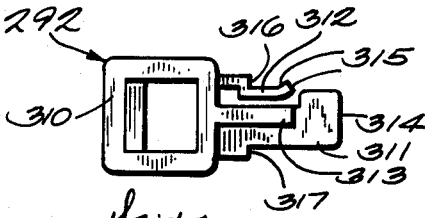
FIG. 64 is a side plan view of a key for the lock of FIG. 58.
Figure 65:
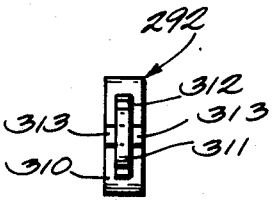
FIG. 65 is a front plan view of the key of FIG. 64.

The key 292 is shown in FIGS. 64 and 65. It has a handle 310, a shank 311 and a detent 312. Each side of the shank 311 has a rib 313 which extends forwardly from the handle 310 and terminates about where an end 314 of the shank 311 which is wider than the rest of the shank begins. The detent 312 extends forwardly from the handle up to, but slightly short of, the end 314 and is resilient in the plane of the shank. The upper surface of the end of the detent 312 is ramped forwardly and rearwardly at 315 and defines a shoulder 316. The lower surface of the shank 311 also defines a shoulder 317 which is opposite from the shoulder 316.

Referring again to FIGS. 56 and 58, the latch 290 and the bushing 291 are assembled to the door 9 by sliding the ramped portions 294 into the wedge structures 283 and simultaneously inserting the cylindrical portion 305 of the bushing 291 into the hole 280 in the door. After the bushing 291 is seated in the hole 280, the latch 290 is slid further rearwardly into the wedge structures 283. The wedge structures 283 bear down on the ramped portions 294 to hold the latch 290 snugly in place to captivate the bushing 291 in the hole 280 with the spacer portion 304 between the top wall of the door and the catches 297. When the latch 290 is as far within the wedge structures 283 as it will go, the tabs 296 snap behind the shoulder ribs 282 to hold the latch in place. As thus mounted, the catches 297 are free to move toward and away from one another. Also, the bushing 291 can rotate freely in the hole 280 and the slot 306 is aligned with the space between the cam surfaces 299 when the bushing 291 is properly angularly oriented.

In order to lock the door 9 against the back 2, the door is shut and the catches 297 enter the apertures 48 in the back 2 (FIG. 6). The ramped ends of the catches cam along the inside edges of the apertures so that they move outwardly. Because the catches 297 are resilient, they snap behind the lock wall 45 of the back 2 when the shoulders 302 of the catches clear the apertures 48 as shown in FIG. 7.

The key 292 must be used to unlock the door 9. The key is inserted into the slot 306 of the bushing 291 with the ribs 313 aligned with the recesses 308 and is rotated until the end of the shank 311 is guided down between the beveled edges 301 of the catches 297. Inserting the key 292 further causes the detent 312 to enter the slot 306 into the outwardly angled portion of the slot to firm up the fit of the key in the bushing 291 and causes the end 314 of the key to move down between the cam surfaces 299. The downward motion of the key is positively stopped when the shoulders 316 and 317 abut against the top surface of the bushing 291. The key is then turned about ⅛ of a turn to urge the catches 297 far enough apart so that the shoulders 302 can clear the apertures 48, and the door is opened.

Figure 66:
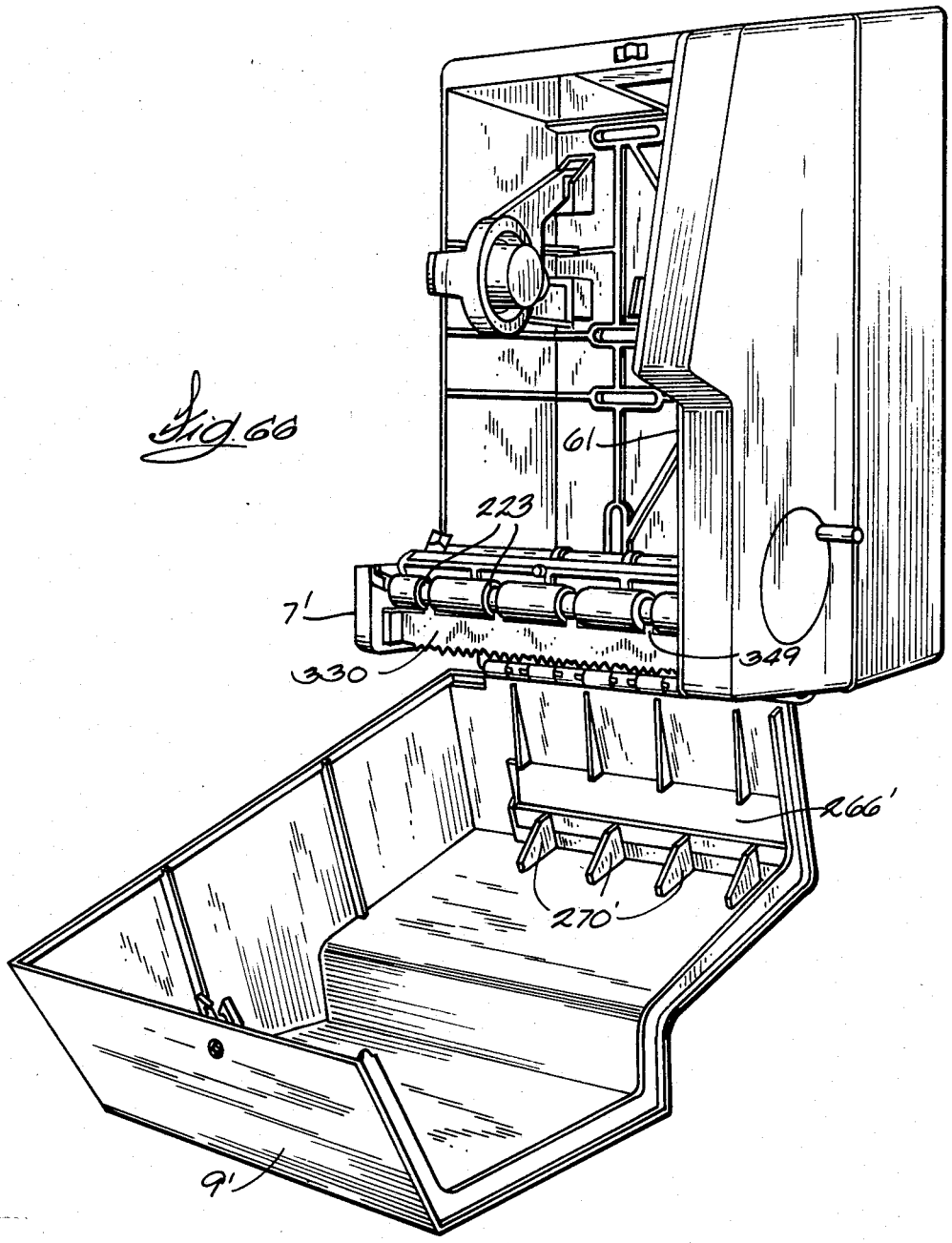
FIG. 66 is similar to FIG. 3 but shows a presently preferred embodiment including a towel cutter bar and a modified door.
Figure 67:
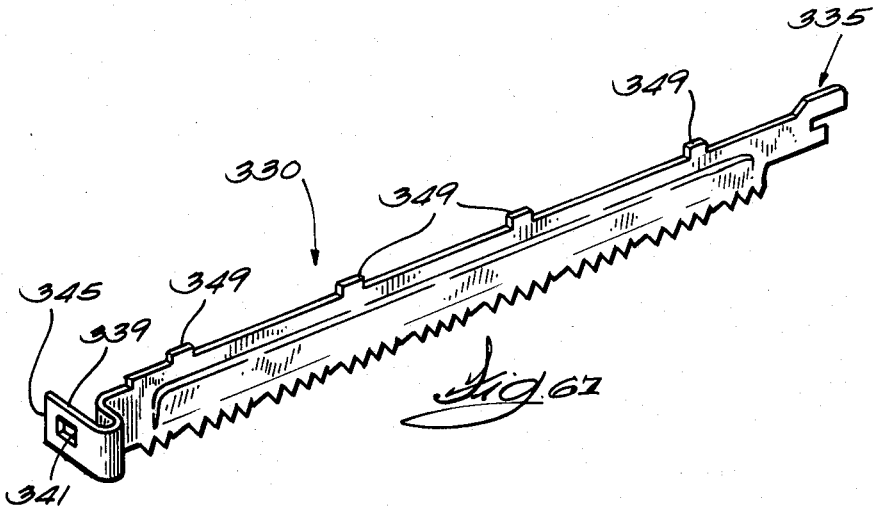
FIG. 67 is a perspective view of the cutter bar of FIG. 66.
Figure 68:
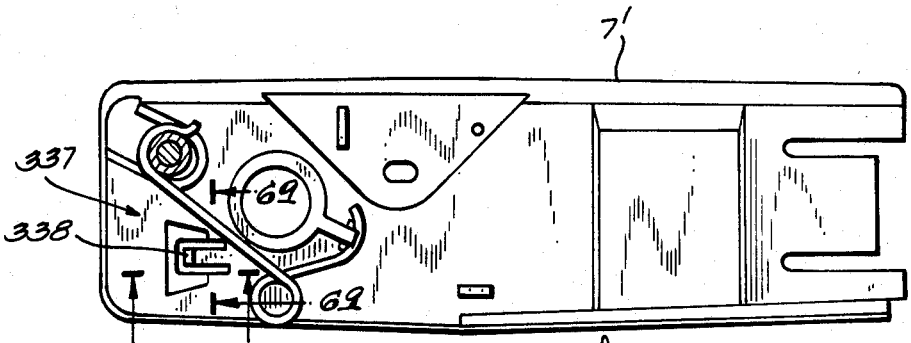
FIG. 68 is a view similar to FIG. 43 but showing the feed roll support arm modified to accommodate the towel cutter bar of FIG. 66.
Figure 69:
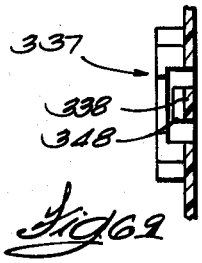
FIG. 69 is a sectional view taken along the plane of the line 69—69 of FIG. 68.
Figure 70:
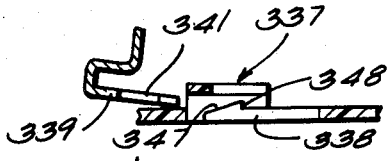
FIG. 70 is a sectional view taken along the plane of the line 70—70 of FIG. 68.

In the presently preferred embodiment, the paper cutting means have been modified from that described above. Referring to FIG. 66, the opening 266' of the door 9' does not have any teeth with which to cut dispensed paper towel. Rather, a metal cutter bar 330 spans the feed roll support arm 7' and the mechanism plate 61 just in front of the drive roll 4. The cutter bar 330 is supported at the right side by a pair of slots 332 and 333 (FIGS. 14, 15 and 16) in the mechanism plate 61 into which a forked end 335 (FIG. 67) of the cutter bar 330 extends. Referring to FIGS. 68, 69 and 70, to support the left end of the cutter 330, the feed roll support arm 7' has a structure 337 which is provided with a tab 338. A left end 339 of the cutter bar 330 is perpendicular to the remainder of the cutter bar 330 and a rectangular hole 341 is formed in the end 339.

After the right end of the cutter bar 330 is inserted into the slots 332 and 333 in the machanism plate 61, the cutter bar 330 is swung toward the back so that the end 339 enters the structure 337 as best shown in FIG. 70. The leading edge 345 of the end 339 slides along a ramped surface 347 of the tab 338 to move the tab 338 away from the end 339. When a shoulder 348 of the tab 338 clears the hole 341, the shoulder snaps behind the edge of the hole 341 to lock the cutter bar 330 in position.

The cutter bar 330 has four projections 349 which extend into the idler roll grooves 223. The projections 349 strip the paper towel from the idler roll as the towel is dispensed. Therefore, the ribs 270' need not extend up into the grooves 223 to perform the same stripping function, and do not in the presently preferred embodiment.

Conclusion

There has been described a paper towel dispenser cabinet having virtually all of its components made of plastic material. This is believed to be the first development of this type of construction in the art of paper towel dispenser cabinets and provides numerous highly useful and significant advantages as compared to prior art cabinets.

Plastic construction allows for ease of assembly. Once the gate is trimmed from the plastic injection molded components of the invention, they are ready for assembly. No complex tools are required. The components of the invention are provided with locking tabs which snap into the respective structures of other components to assemble the dispenser. Virtually no mechanical fasteners are required as the dispenser simply snaps together. However, while the dispenser is easily assembled, the locking tabs are designed to impede unauthorized disassembly.

Plastic construction also provides for ease of assembly by reducing the number of secondary operations required to be performed. Injection molding is very flexible so that parts which previously had to be mechanically fastened to other parts can be integrally molded with the other parts. For example, the hinge elements and the cutting edge of a door of the present invention can be molded as an integral part of the door. Thereby, the secondary operations required to attach a cutting edge and a hinge element to a metal door are eliminated.

Plastic construction simplifies inventory and production planning. The invention has greatly fewer parts than prior dispensers. Furthermore, the invention requires greatly fewer secondary operations and no complicated tooling to be assembled. While the molds that are used to produce the major components of the invention are sophisticated, they are very reliable and not susceptible to breakdown. Moreover, they are interchangeable with different injection molding machines so that should an injection molding machine running with the molds break down, the molds could be simply transferred to another operative machine. Similarly, should a production planner have a problem with a particular supplier, the planner could simply transfer the molds to another supplier to be run in the other supplier's injection molding machines. Thereby, breakdowns and bottlenecks in the production line are avoided.

The asymmetrical design of the invention allowing for an interchangeable mechanism module simplifies assembly, inventory and production planning and field maintenance. The mechanism module can be easily modified to provide any one of four modes of operation. There are only about nine parts which are not common to all the different modes of operation of a dispenser of the present invention. None of these parts is ever incorporated anywhere but in the mechanism module so that all of the major components of the dispenser, other than the mechanism module, are common to all the modes of the dispenser, thereby greatly simplying assembly, inventory and production planning and field maintenance. Furthermore, regardless of what mode of operation the mechanism module is subassembled to produce, the module is compatible with the other components of the dispenser. Subassembly planning therefore becomes less critical since any type of mechanism module can be used with the other components of the dispenser and vice versa.

Lastly, plastic construction and an interchangeable dispenser mechanism module results in great cost reduction. Injection molding is performed at a relatively high rate on automatic machines. In addition, all of the materials of the dispenser of the invention are common plastic materials and therefore relatively inexpensive. Though molds are not in themselves inexpensive, a single mold can, in some instances, be modified with inserts to be capable of producing more than a single part. Finally, since the invention can be assembled quickly and easily without complex tooling or many secondary operations, great savings are realized in tooling maintenance and replacements, and assembly time. Suitable plastic resins for (a) the back and door of the dispenser, (b) the mechanism module including the various gears, pinions, racks and other parts of the operating mechanism housed in the module, (c) the feed roll support arm and the reserve roll support arm, and (d) the lock and key include ABS resins, acetal resins, nylon resins, urethane resins, and high impact polystyrene resins.

We claim:

1. A paper towel dispenser cabinet comprising, in combination:

(1) a molded plastic back including a rear wall, spaced top and bottom walls, and spaced first and second side walls;

(2) a molded plastic door including a front wall having opposed first and second edge portions, spaced top and bottom walls extending from the front wall, and a first side wall extending from the first side edge portion of the front wall, the door being hingedly connected to the back;

(3) a mechanism module including a molded plastic inner member and a molded plastic outer member forming a housing for operating mechanism for the dispensing of paper towel from the cabinet, the mechanism module being secured to the back with the outer member thereof coplanar with and extending from the second side wall of the back;

(4) the back, door and mechanism module forming a cabinet enclosure for the storage of paper towels wherein, with the door closed, the top and bottom walls of the door and the back form the top and the bottom of the enclosure, the first side wall of the door and the first side wall of the back form one side of the enclosure, and the second side wall of the back and the outer member of the mechanism module form an opposite side of the enclosure.

2. A paper towel dispenser cabinet according to claim 1, further including:

one or more locking structures integrally molded with the rear wall of the back and positioned interior of the cabinet and one or more locking members integrally molded with and extending from the mechanism module, each locking member engaging a locking structure for securing the mechanism module to the back.

3. A paper towel dispenser cabinet according to claim 2, further including:

a guide wall formed as an integrally molded element of the back and extending from front to rear thereof, and a plurality of ribs extending from the guide wall and converging toward the rear wall;

a marginal portion of the mechanism module conforming to the guide wall and adapted to engage the ribs thereof to provide a wedging action for holding the mechanism module to the back.

4. A paper towel dispenser cabinet according to claim 1, wherein:

the bottom wall of the back includes a plurality of ramps integrally molded with the bottom wall and adapted to cradle a primary roll of paper towel therebetween.

5. A paper towel dispenser cabinet according to claim 1, 2, 3 or 4, further including:

means for supporting a reserve roll of paper towel inside the cabinet comprising a molded plastic hub rotatably carried by the inner member of the mechanism module for supporting one end of the reserve roll and a molded plastic reserve roll support arm mounted to the back adjacent to the first side wall of the back for supporting an opposite end of the reserve roll.

6. A paper towel dispenser cabinet according to claim 1, 2, 3 or 4, further including:

a molded plastic feed roll support arm secured to the first side wall of the back and a pair of feed rolls through which paper towel is threaded for dispensing paper towel from the cabinet, each feed roll having one end rotatably supported in the feed roll support arm and an opposite end rotatably supported in the mechanism module.

7. A paper towel dispenser cabinet according to claim 1, 2, 3 or 4, wherein:

the door includes an opening through which paper towel is dispensed from the cabinet.

8. A paper towel dispenser cabinet according to claim 1, 2, 3 or 4, further including:

cutting means for severance of a dispensed length of paper towel from a roll thereof stored within the cabinet.

9. A paper towel dispenser cabinet according to claim 1, 2, 3 or 4, wherein:

the door includes a plurality of hinge elements integrally molded with the bottom wall thereof; the back includes a plurality of spaced hinge elements integrally molded with the bottom wall thereof; and the hinge elements on the door and the hinge elements on the back are interdigitated so that a hinge pin can be inserted therethrough to provide a hinged connection between the door and the back.

10. In a paper towel dispenser cabinet of the type adapted to store one or more rolls of paper towel and including an operating mechanism which rotatably drives a delivery mechanism in engagement with the paper towel to allow a user to dispense paper towel from the rolls according to a mode of operation, the improvement comprising:

a mechanism module in which the operating mechanism is housed and which forms a portion of the exterior of the dispenser cabinet, the mechanism module including a mechanism plate to mount the operating mechanism, the mechanism plate being suitable to mount the components of a variety of operating mechanisms, each said operating mechanism providing a different mode of operation, so that the mode of operation of the dispenser can be changed by changing mechanism modules.

11. The improvement of claim 10, wherein the operating mechanism housed in the mechanism module comprises:

crank means rotatably mounted on the mechanism plate and operable by a user for dispensing paper towel; and gear means for coupling the crank means to the delivery mechanism.

12. The improvement of claim 10, wherein the operating mechanism housed in the mechanism module comprises:

lever means mounted on the mechanism plate for reciprocating movement in a vertical plane and operable by a user for dispensing paper towel; and gear means for converting the vertical motion of the lever means into rotary motion to drive the delivery mechanism.

13. The improvement of claim 10, wherein the operating mechanism housed in the mechanism module comprises:

crank means rotatably mounted on the mechanism plate and operable by a user for dispensing paper towel;

gear means for coupling the crank means to the delivery mechanism; and metering means in engagement with the gear means operable by a user to release the crank means and for limiting the number of successive rotations of the crank means between operations of the metering means by the user.

14. The improvement of claim 10, wherein the operating mechanism housed in the mechanism module comprises:

lever means mounted on the mechanism plate for reciprocating movement in a vertical plane and operable by a user for dispensing paper towel;

gear means for converting the vertical motion of the lever means into rotary motion to drive the delivery mechanism; and metering means in engagement with the gear means operable by a user to release the lever means and for limiting the number of successive reciprocations of the lever means between operations of the metering means by the user.

* * * * *